US011485156B2

(12) United States Patent
Yoshino et al.

(10) Patent No.: US 11,485,156 B2
(45) Date of Patent: Nov. 1, 2022

(54) RECORDING DEVICE AND METHOD FOR CONTROLLING RECORDING DEVICE

(71) Applicant: SEIKO EPSON CORPORATION, Tokyo (JP)

(72) Inventors: Satoshi Yoshino, Matsumoto (JP); Hiroki Shinagawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/348,744

(22) Filed: Jun. 15, 2021

(65) Prior Publication Data

US 2021/0394537 A1 Dec. 23, 2021

(30) Foreign Application Priority Data

Jun. 18, 2020 (JP) ..... JP2020-105142

(51) Int. Cl.

| | |
|---|---|
| ***B41J 13/02*** | (2006.01) |
| ***B41J 13/00*** | (2006.01) |
| ***B41J 15/04*** | (2006.01) |
| ***B65H 5/06*** | (2006.01) |
| *B41J 11/00* | (2006.01) |
| *B65H 7/02* | (2006.01) |

(52) U.S. Cl.

CPC ..... *B41J 13/025* (2013.01); *B41J 13/0009* (2013.01); *B41J 13/0018* (2013.01); *B41J 13/0027* (2013.01); *B41J 15/046* (2013.01); *B65H 5/06* (2013.01); *B65H 5/062* (2013.01); *B41J 11/0095* (2013.01); *B41J 13/02* (2013.01); *B65H 7/02* (2013.01); *B65H 2511/22* (2013.01); *B65H 2511/51* (2013.01); *B65H 2511/514* (2013.01); *B65H 2515/704* (2013.01)

(58) Field of Classification Search

CPC .. B41J 13/025; B41J 13/0009; B41J 13/0018; B41J 13/0027; B41J 15/046; B41J 11/0095; B41J 13/02; B65H 5/06; B65H 5/062; B65H 7/02; B65H 2511/22; B65H 2511/51; B65H 2511/514; B65H 2515/704

See application file for complete search history.

(56) References Cited

U.S. PATENT DOCUMENTS

2006/0164491 A1* 7/2006 Sakuma ..... B41J 13/106 347/104
2015/0070455 A1* 3/2015 Mimoto ..... B41J 11/0095 347/104

FOREIGN PATENT DOCUMENTS

JP 2007030523 A 2/2007

* cited by examiner

*Primary Examiner* — Henok D Legesse
(74) *Attorney, Agent, or Firm* — Chip Law Group

(57) ABSTRACT

A recording device includes a recording head, a transport roller set, and a controller that controls a driving source that drives a transport driving roller. The controller judges whether a rear end that is an upstream end of a medium in a transport direction crosses a kicking region set in a range present downstream of a nipping position of the transport roller set in a transport direction. When the controller judges that the rear end does not cross the kicking region, the controller adjusts a feeding amount for at least one of a plurality of transport operations to be performed until the rear end reaches the kicking region in such a manner that the rear end of the medium crosses the kicking region.

15 Claims, 12 Drawing Sheets

RECORDING DEVICE AND METHOD FOR CONTROLLING RECORDING DEVICE

The present application is based on, and claims priority from JP Application Serial Number 2020-105142, filed Jun. 18, 2020, the disclosure of which is hereby incorporated by reference herein in its entirety.

BACKGROUND

1. Technical Field

The present disclosure relates to a recording device that includes a transport roller set that transports a medium, and a recording head that performs recording on the transported medium, and to a method for controlling the recording device.

2. Related Art

For example, JP-A-2007-30523 discloses a recording device that includes a pair of transport rollers that transport a medium along a transport path in a transport direction, and a recording head that records an image on the transported medium.

After a medium detector detects a rear end (upstream end) of the medium and before the rear end of the medium enters in a low-speed region set in a region including a nipping position where the rear end of the medium is nipped by the pair of transport rollers, an operation of transporting the medium at a normal speed is performed. When the rear end of the medium enters in the low-speed region, the operation is switched to an operation of transporting the medium at a lower speed than the normal speed. This suppresses kicking of the medium.

However, when the rear end of the medium enters in the low-speed region, the operation is switched to the operation of transporting the medium at the lower speed than the normal speed. In this case, an effect of the kicking is reduced, but the medium is kicked with force corresponding to the low speed. Therefore, an effect of suppressing the kicking of the medium is small. For example, when the transport speed of the medium is reduced to a very low speed close to zero, a large effect of suppressing the kicking is expected. However, this method takes long time to transport the medium due to the very low transport speed and reduces throughput for recording.

SUMMARY

To solve the foregoing problems, according to an aspect of the present disclosure, a recording device includes a recording head that performs recording on a recording medium, a transport roller set including a transport driving roller and a transport driven roller that transport the recording medium toward the recording head in a transport direction, a medium detector that detects an end of the recording medium at a position upstream of the transport roller set in the transport direction, an encoder that detects a rotational amount of the transport driving roller, and a controller that controls a driving source that drives the transport driving roller. The controller judges whether a rear end that is an upstream end of the recording medium in the transport direction crosses a kicking region set in a range present downstream of a nipping position of the transport roller set in the transport direction and shorter than an amount of feeding of the recording medium by the transport roller set.

When the controller judges that the rear end of the recording medium does not cross the kicking region, the controller adjusts the feeding amount for at least one of a plurality of transport operations to be performed until the rear end of the recording medium reaches the kicking region in such a manner that the rear end of the recording medium crosses the kicking region.

To solve the foregoing problems, according to another aspect of the present disclosure, there is provided a method for controlling a recording device including a recording head that performs recording on a recording medium, a transport roller set including a transport driving roller and a transport driven roller that transport the recording medium toward the recording head in a transport direction, a medium detector that detects an end of the recording medium at a position upstream of the transport roller set in the transport direction, an encoder that detects a rotational amount of the transport driving roller, and a controller that controls a driving source that drives the transport driving motor includes causing the controller to determine whether a rear end that is an upstream end of the recording medium in the transport direction crosses a kicking region set in a range present downstream of a nipping position of the transport roller set in the transport direction and shorter than an amount of feeding of the recording medium by the transport roller set and causing, when the controller judges that the rear end of the recording medium does not cross the kicking region, the controller to adjust the feeding amount for at least one of a plurality of transport operations to be performed until the rear end of the recording medium reaches the kicking region in such a manner that the rear end of the recording medium crosses the kicking region.

DESCRIPTION OF EXEMPLARY EMBODIMENTS

Figure 1:
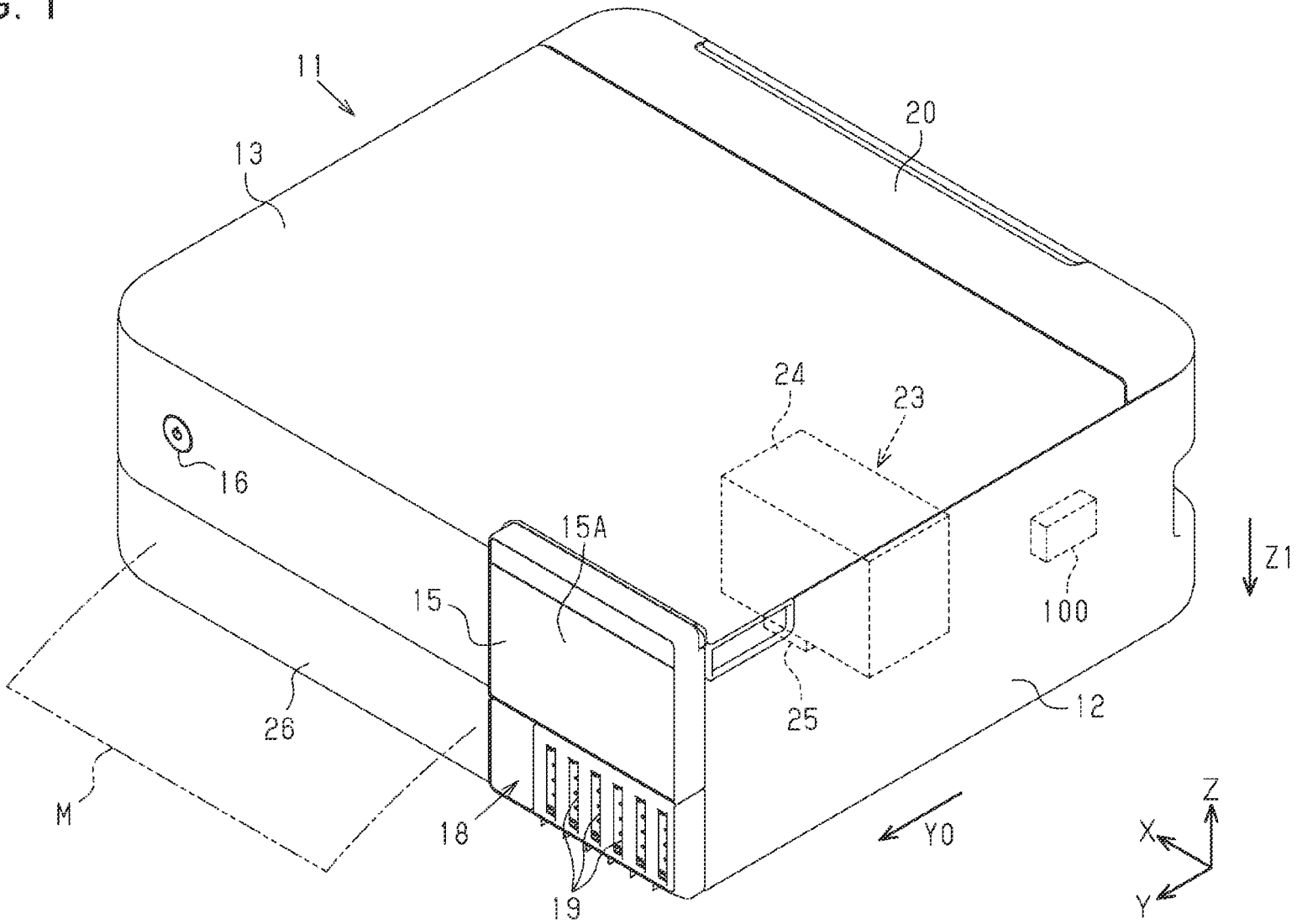
FIG. 1 is a perspective view of a recording device according to an embodiment.

Hereinafter, an embodiment of a recording device is described with reference to the drawings. In FIG. 1, it is assumed that a recording device 11 is put on a horizontal surface and three virtual axes perpendicular to each other are an X axis, a Y axis, and a Z axis. The X axis is a virtual axis parallel to a scan direction of a recording head (described later). The Y axis is a virtual axis parallel to a transport direction at a recording position where the recording head performs recording on a recording medium. Therefore, a direction parallel to the Y axis is also referred to as transport direction Y. Two directions toward which the recording head reciprocates are parallel to the X axis and collectively referred to as scan direction X. The Z axis is a virtual axis parallel to a vertical direction Z1. A transport direction Y0 of the recording medium changes depending on the position of the recording medium on a transport path. A direction that intersects the transport direction Y0 in which the recording medium is transported is also referred to as width direction X. In the embodiment, the width direction X is the same as the scan direction X.

Configuration of Recording Device

Figure 11:
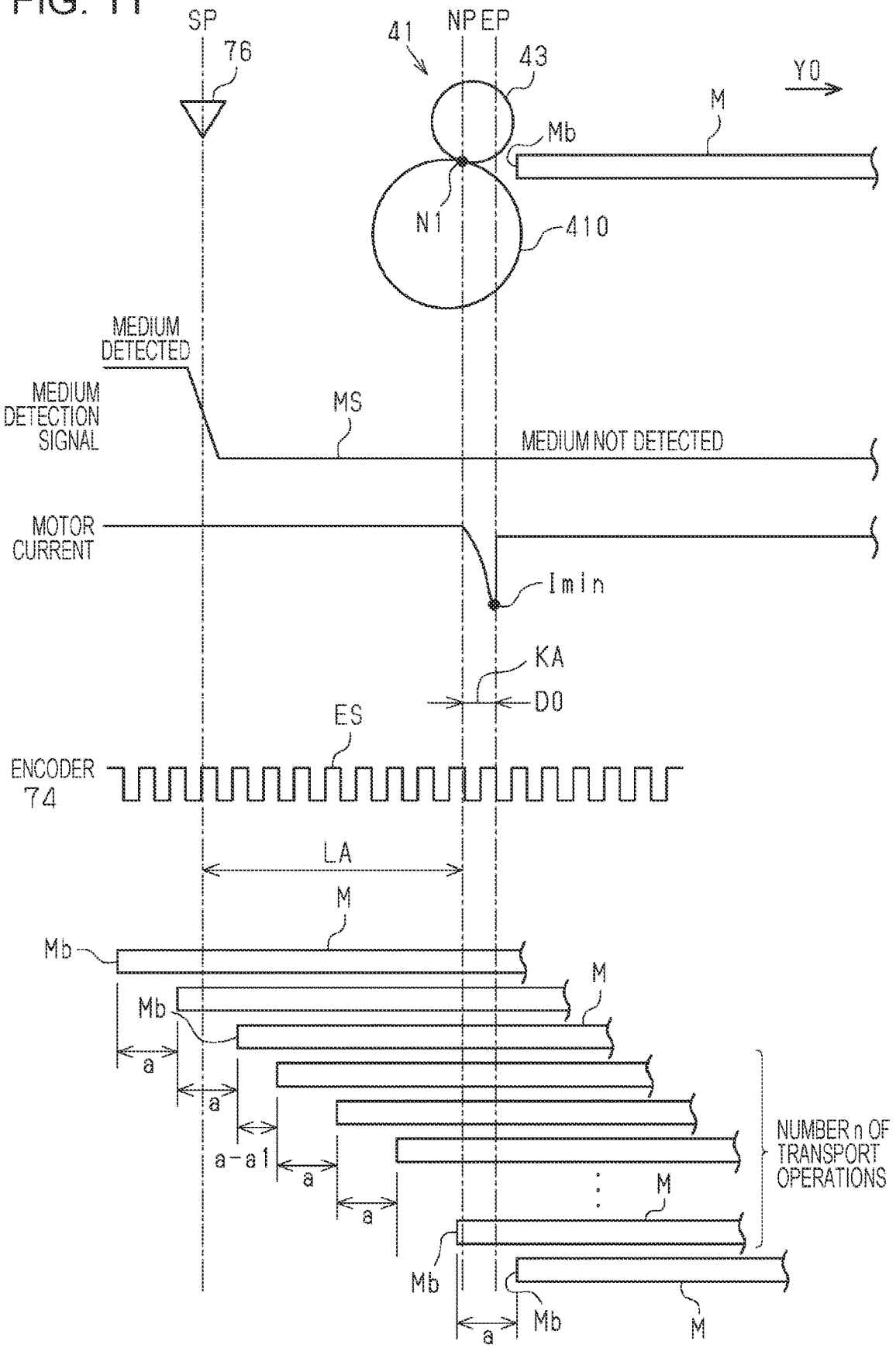
FIG. 11 is a schematic diagram describing the correction transport control.

The recording device 11 illustrated in FIG. 11 is a serial recording type ink jet printer. As illustrated in FIG. 1, the recording device 11 includes a device body 12 and a cover 13 disposed on the device body 12 and able to be opened and closed. The recording device 11 has an overall substantially rectangular parallelepiped shape.

The recording device 11 includes a control panel 15 on a front surface of the recording device 11. The control panel 15 includes a display section (not illustrated) and an operating section (not illustrated) including an operating button. The recording device 11 includes a power control section 16 on a front surface of the device body 12. The display section may be a touch panel, and a control function of the touch panel may constitute the operating section.

The recording device 11 includes a storage section 18 that stores a plurality (6 in the embodiment) of liquid supply sources 17 (refer to FIG. 2) on the front right side of the device body 12. The storage section 18 includes a plurality of window sections 19 for the respective liquid supply sources 17. A user can visually recognize surface levels of liquids stored in the liquid supply sources 17 via the window sections 19.

The recording device 11 includes a feeding cover 20 disposed on the upper rear side of the recording device 11 and able to be opened and closed. The feeding cover 20 is opened and closed by pivoting around its rear end. In the device body 12, a feeder 21 is stored on the inner side of the feeding cover 20 in its closed state (illustrated in FIG. 1). The feeder 21 feeds a recording medium M (hereinafter also merely referred to as "medium M"), such as paper. The feeder 21 includes a feeding tray 22 (refer to FIG. 2) on which the medium M is to be put. When the feeding cover 20 is opened, the user may put the medium M on the exposed feeding tray 22.

As illustrated in FIG. 1, the recording device 11 includes a recorder 23 that performs recording on the transported medium M. The recorder 23 includes the recording head 25 that performs recording on the medium M. The recorder 23 according to the embodiment is, for example, of a serial recording type. The recorder 23 of the serial recording type includes a carriage 24 able to reciprocate in the scan direction X and the recording head 25 held under the carriage 24. The recorder 23 is coupled to the liquid supply sources 17 through liquid supply tubes (not illustrated). Liquids are supplied from the liquid supply sources 17 through the liquid supply tubes to the recording head 25. The recording head 25 ejects the liquids onto the medium M from a plurality of nozzles while moving together with the carriage 24.

A discharge cover 26 is disposed at a lower front portion of the recording device 11 and able to be opened and closed. The discharge cover 26 pivots around its lower end. In the device body 12, a stacker 27 (refer to FIG. 4) that receives the medium M after recording is stored on the rear side of the discharge cover 26 in a closed state (illustrated in FIG. 1). In a state in which the discharge cover 26 is opened, the stacker 27 can be slid in the transport direction Y and positioned at a reception position where the stacker 27 receives the medium M.

The recording device 11 includes a controller 100 that performs various types of control. The controller 100 controls the carriage 24 and the recording head 25. The controller 100 controls the transport of the medium M, the display of the control panel 15, a power supply, and the like.

Next, a detailed inner configuration of the recording device 11 is described with reference to FIGS. 2 and 3.

Figure 2:
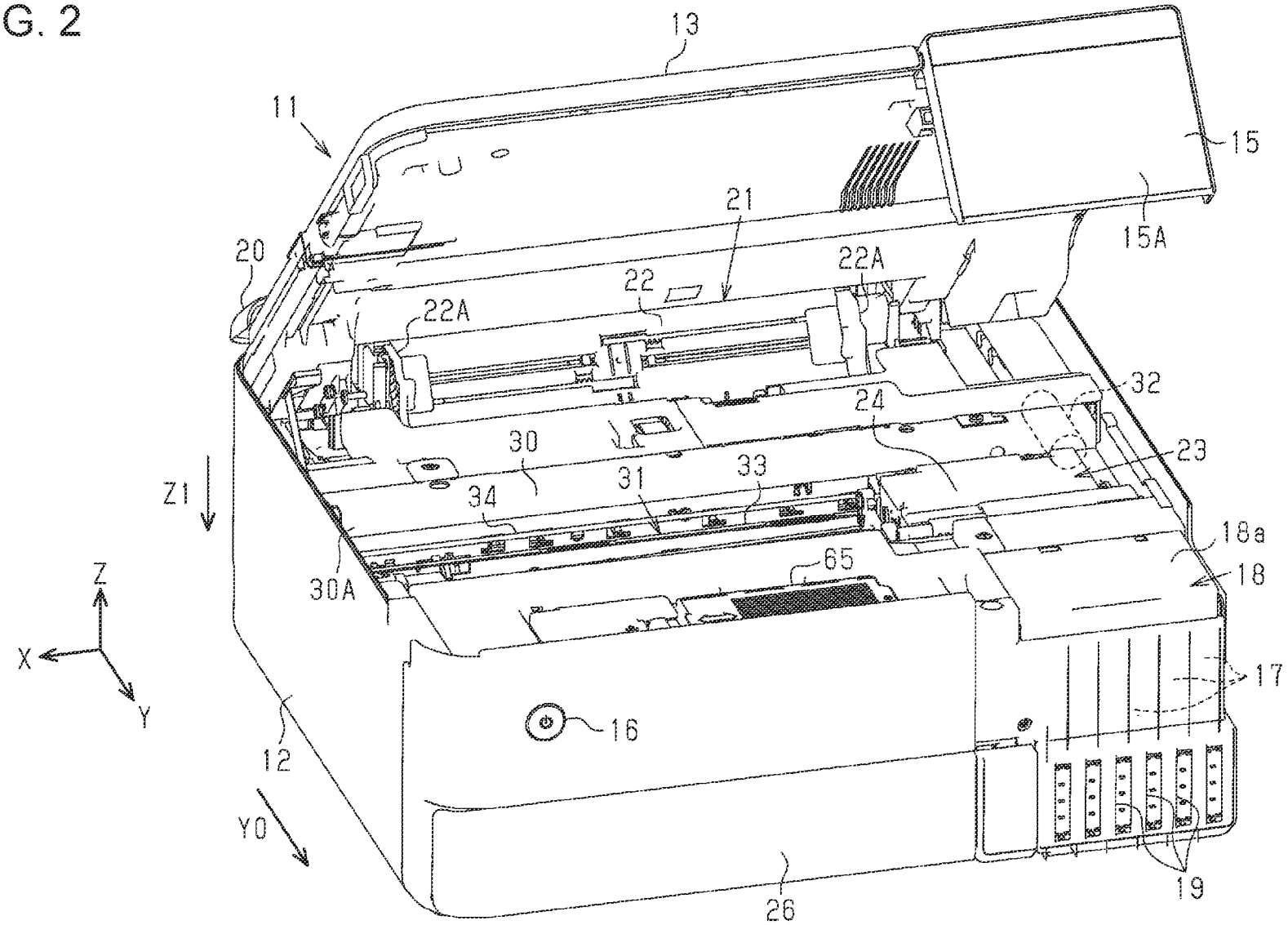
FIG. 2 is a perspective view illustrating the recording device in a state in which a cover is opened.

As illustrated in FIG. 2, a main frame 30 is included in the device body 12 and extends in the width direction X. The main frame 30 includes a pair of guide rails 30A (also refer to FIG. 3) that guide the carriage 24. The guide rails 30A extend in the scan direction X in parallel to each other. The carriage 24 is held by the pair of guide rails 30A in such a manner that the carriage 24 can move in the scan direction X. A moving mechanism 31 (refer to FIG. 2) that moves the carriage 24 in the scan direction X is disposed between the main frame 30 and the carriage 24. The moving mechanism 31 is of, for example, a belt-driven type. The moving mechanism 31 includes a carriage motor 32 and an endless timing belt 33 stretched in the scan direction X. The carriage motor 32 is a driving source that drives the carriage 24. The carriage 24 is fixed to a portion of the timing belt 33. The carriage motor 32 rotates forwardly and backwardly, thereby causing the carriage 24 to reciprocate in the scan direction X via the timing belt 33.

A linear encoder 34 is disposed on the main frame 30 and extends in the scan direction X. The linear encoder 34 includes a linear scale extending in the scan direction X and a sensor (not illustrated) attached to the carriage 24. The sensor detects many light transmissive sections arranged at fixed intervals on the linear scale and outputs a pulse signal including the number of pulses proportional to the amount of movement of the carriage 24.

In the storage section 18, a supply cover 18*a* with an upper portion able to be opened and closed is disposed. When the user recognizes, via the window sections 19, that a remaining amount of a liquid stored in any of the liquid supply sources 17 is small, the user opens the cover 13 and the supply cover 18*a* and pours a liquid into the liquid supply source 17 through an inlet (not illustrated) of the liquid supply source 17 from a liquid bottle.

Figure 3:
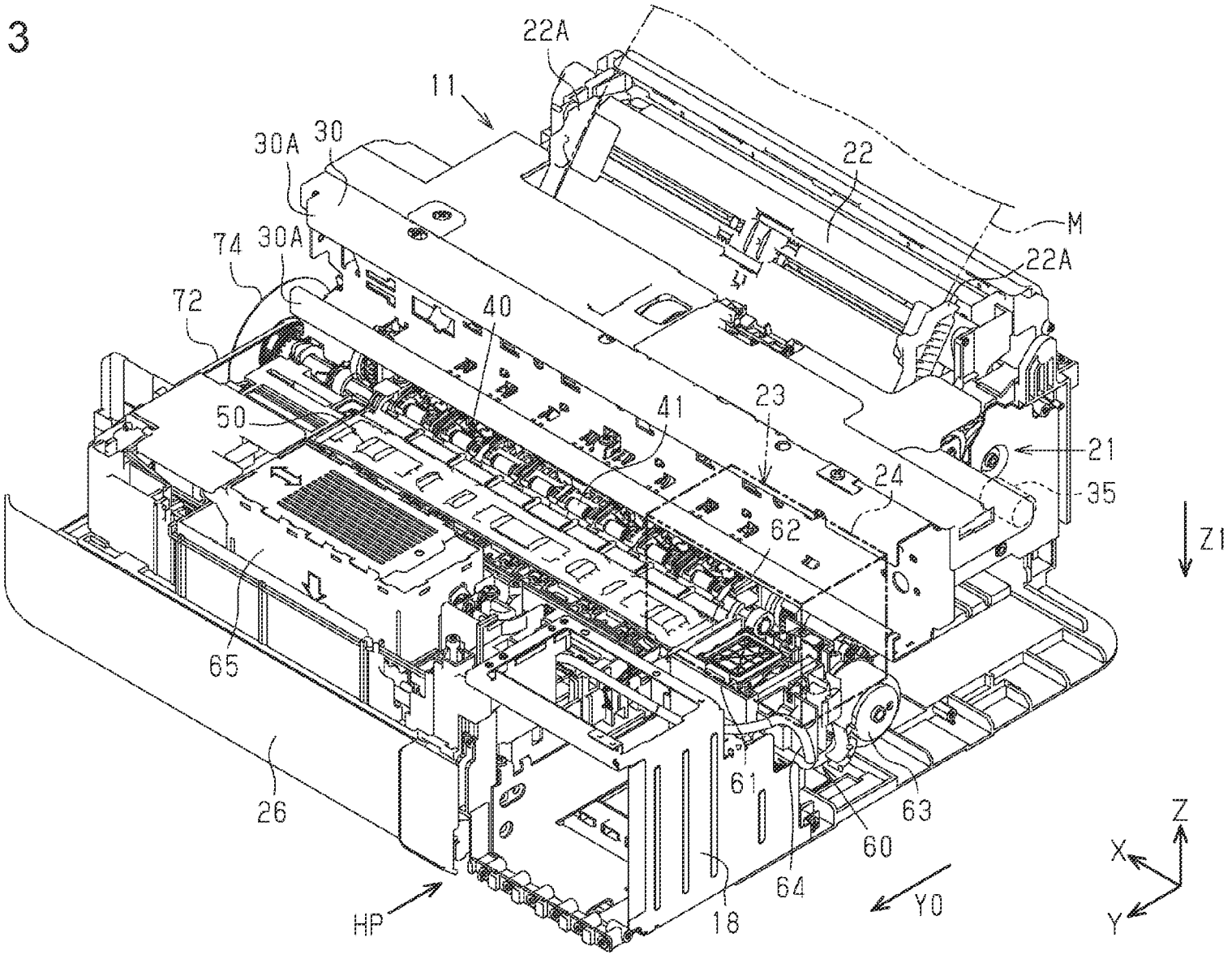
FIG. 3 is a perspective view illustrating the recording device in a state in which a housing is removed.

As illustrated in FIG. 3, a pair of edge guides 22A is disposed on the feeding tray 22 on which the medium M is to be put. The medium M put on the feeding tray 22 is pinched and positioned in the width direction X by the pair of edge guides 22A. The feeder 21 includes a feeding motor 35 as a driving source. The feeder 21 feeds the medium M put on the feeding tray 22 along the transport path in the transport direction Y0.

As illustrated in FIG. 3, the recording device 11 includes a transporter 40 and a medium holding member 50. The transporter 40 transports the medium M fed from the feeder 21 in the transport direction Y0. The medium holding member 50 holds the medium M. The medium holding member 50 has an elongated shape and extends in the width direction X. The medium holding member 50 has a length enabling the medium holding member 50 to hold an overall portion having the maximum width in the width direction and included in the medium M. The recorder 23 performs recording on a portion included in the transported medium M and held by the medium holding member 50.

The recording device 11 alternately repeatedly performs a recording operation of moving the carriage 24 once and causing the recording head 25 to perform recording for one pass and a transport operation of transporting the medium M to a next recording position, thereby recording a character or an image on the medium M. When the accuracy of a transport position that is a next recording position where the medium transported by the transporter 40 is stopped is high, a high recording quality is secured. An operation of moving the carriage 24 once in the scan direction X in recording is referred to as "pass". In serial recording, the recording device 11 performs one transport operation of transporting the medium M to a next recording position and an operation of moving the carriage 24 in the scan direction X once and performing recording on the medium M transported to the recording position for one pass. In the embodiment, one transport operation performed for the carriage 24 is also referred to as "transport operation for one pass". An amount by which the medium M is transported by a transport operation for one pass is referred to as "feeding amount for one pass".

The carriage 24 indicated by a dashed-and-double-dotted line in FIG. 3 is positioned at a home position HP that is a standby position when recording is not performed. A maintenance device 60 that maintains the recording head 25 is disposed under and opposite to the carriage 24 positioned at the home position HP. The maintenance device 60 includes a cap 61 with which the recording head 25 is capped, a wiper 62 that wipes a nozzle surface 25A (refer to FIG. 6) of the recording head 25, and a suction pump 63. The suction pump 63 communicates with the cap 61 through a tube (not illustrated).

The maintenance device 60 drives the suction pump 63 in a capping state in which the cap 61 is in contact with the nozzle surface 25A of the recording head 25 and surrounds the nozzles of the recording head 25. When the suction pump 63 is driven, the pressure of air in a closed space formed between the nozzle surface 25A and the cap 61 and communicating with the nozzles becomes negative, foreign matters, such as a thickened liquid, air bubbles, and paper powder, are forcibly discharged from the nozzles, and the nozzles recover from ejection failures. The liquid (discharged liquid) discharged from the nozzles to the cap 61 by the cleaning is transmitted by the driving of the suction pump 63 to a discharged liquid tank 65 through a discharged liquid tube 64.

Figure 4:
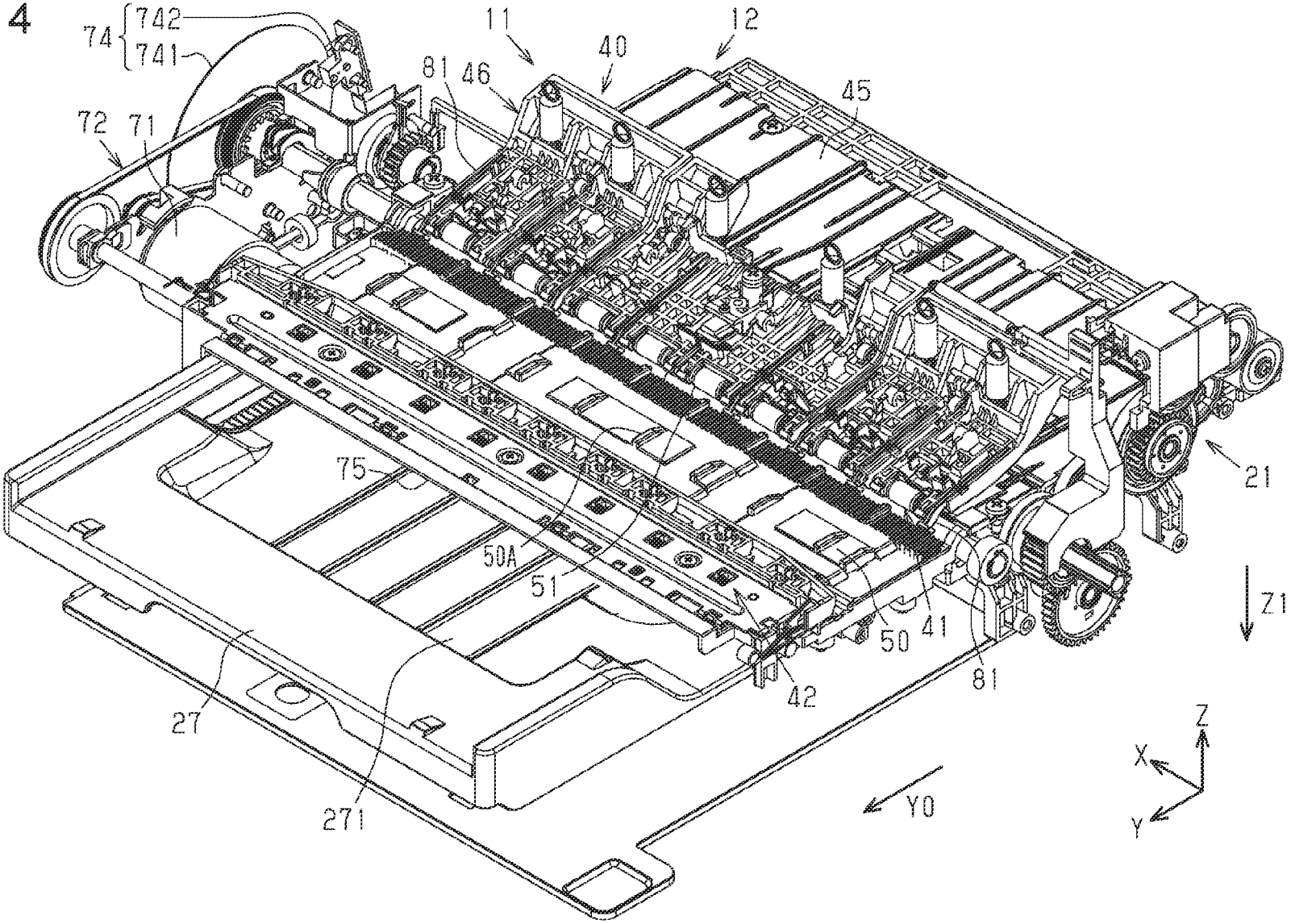
FIG. 4 is a perspective view illustrating a portion of the recording device in the state in which the housing is removed.
Figure 5:
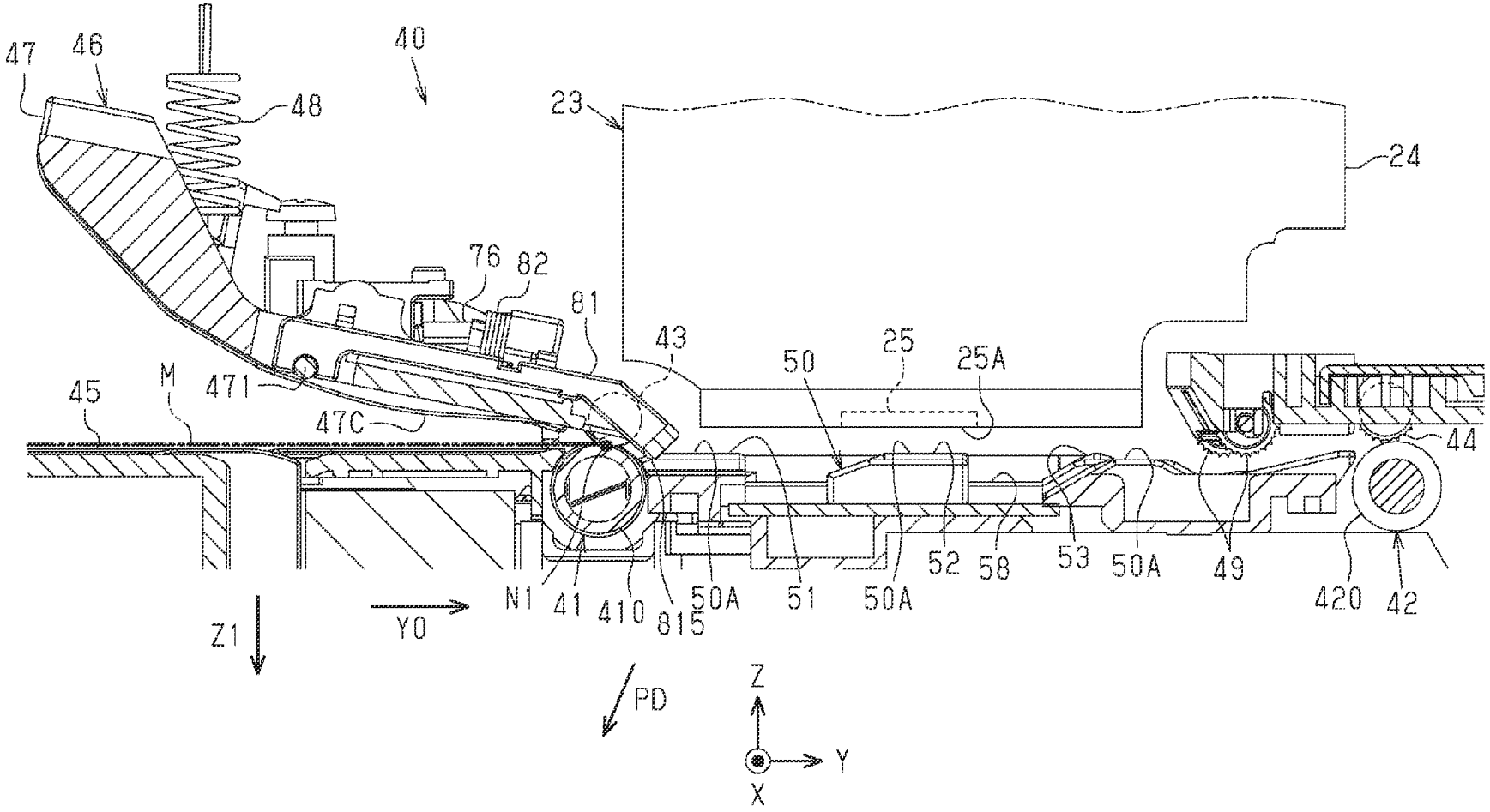
FIG. 5 is a side cross-sectional view illustrating a portion of a transporter and a portion of a recorder.

As illustrated in FIGS. 4 and 5, the transporter 40 includes a transport roller set 41 disposed upstream of the medium holding member 50 in the transport direction Y0, and a discharge roller set 42 disposed downstream of the medium holding medium 50 in the transport direction Y0. As illustrated in FIG. 5, the transport roller set 41 includes a transport driving roller 410 and transport driven rollers 43. The transport driving roller 410 and the transport driven rollers 43 transport the medium M toward the recording head 25 in the transport direction Y0. In other words, the transport roller set 41 is composed of the single transport driving roller 410 and the plurality of transport driven rollers 43 that contact the transport driving roller 410. The discharge roller set 42 is composed of a plurality of discharge driving rollers 420 (refer to FIG. 6) and a plurality of discharge driven rollers 44. The discharge driven rollers 44 are, for example, jag rollers. Each of the discharge driven rollers 44 has a plurality of teeth arranged along an outer circumference of the discharge drive roller 44.

As illustrated in FIG. 4, the transporter 40 includes a plate-shaped medium guide member 45 and a medium guide mechanism 46. The medium guide member 45 holds a back surface of the fed medium M. The medium guide mechanism 46 is disposed above the medium guide member 45 via the transport path for the medium M. As illustrated in FIG. 5, the medium guide mechanism 46 includes a guide member 47, the plurality of transport driven rollers 43, and a biasing member 48. The guide member 47 guides the medium M along the transport path and is able to pivot. The transport driven rollers 43 are held by a downstream end of the guide member 47 in the transport direction Y0. The biasing member 48 biases the guide member 47 in such a manner that the transport driven rollers 43 become closer to the transport driving roller 410.

As illustrated in FIG. 4, the recording device 11 includes a transport motor 71 and a power transmission mechanism 72. The transport motor 71 is a driving source that drives the transporter 40. The power transmission mechanism 72 transmits power of the transport motor 71 to the driving rollers 410 and 420 (refer to FIG. 6). The controller 100 controls the transport motor 71 that is a driving source that drives the transport driving roller 410. The discharge driving rollers 420 are driven by the transport motor 71. Therefore, the transport motor 71 is a common driving source for driving the transport driving roller 410 and the discharge driving rollers 420. The power transmission mechanism 72 includes a gear train that transmits power of the transport motor 71 to the transport driving motor 410, and a timing belt that transmits a rotation of the transport driving roller 410 to the discharge driving rollers 420. The recording device 11 includes an encoder 74 that detects a rotational amount of the transport driving roller 410. The encoder 74 is a rotary encoder that includes a rotation scale 741 fixed to an end of a rotary shaft of the transport driving roller 410, and an optical sensor 742 that detects a rotational amount of the rotary scale 741. The encoder 74 outputs a detection pulse signal ES (refer to FIG. 8) including the number of pulses proportional to a rotational amount of the transport driving roller 410.

As illustrated in FIG. 4, the stacker 27 includes a quadrangular plate-shaped mounting section 271. The stacker 27 moves between a retraction position illustrated in FIG. 4 and the reception position to which the stacker 27 slides downstream in the transport direction Y0 from the retraction position. A discharge port 75 is opened and present above the stacker 27. The medium M after recording is discharged from the discharge port 75. The medium M discharged from the discharge port 75 after the recording is put on the stacker 27 positioned at the reception position. The stacker 27 may be an electric stacker that is driven by power of an electric motor. Alternatively, the stacker 27 may be a manual stacker that is manually slid by the user.

As illustrated in FIG. 5, the medium holding member 50 includes first ribs 51 on an upstream end of the medium holding member 50 in the transport direction Y0, second ribs 52 present downstream of the first ribs 51 in the transport direction Y0, and third ribs 53 present downstream of the second ribs 52 in the transport direction Y0. The first ribs 51 are arranged at intervals in the width direction X, the second ribs 52 are arranged at intervals in the width direction X, and the third ribs 53 are arranged at intervals in the width direction X. The positions of the first ribs 51 in the width direction X are the same, the positions of the second ribs 52 in the width direction X are the same, and the positions of the third ribs 53 in the width direction X are the same. Top surfaces of the ribs 51 to 53 form holding surfaces 50A for holding the medium M.

As illustrated in FIG. 5, the medium holding member 50 includes a liquid absorber 58 disposed around one or two of the second ribs 52 in such a manner that the liquid absorber 58 surrounds the one or two second ribs 52. When the medium M with a specified size is held by the second ribs 52, the liquid absorber 58 absorbs a liquid ejected from a nozzle of the recording head 25 and spreading out of both ends of the medium M in the width direction X.

As illustrated in FIGS. 4 and 5, a medium detector 76 that detects the medium M is attached to a central portion of the medium guide mechanism 46 in the width direction X. The medium detector 76 is disposed upstream of the transport roller set 41 in the transport direction Y0 and detects an end of the medium M. The guide member 47 has a lower surface opposite to the transport path for the medium M and serving as a guide surface 47C (refer to FIG. 5) for guiding the medium M.

As illustrated in FIG. 5, guide rollers 49 are disposed above the transport path between a scan region of the recorder 23 and the discharge roller set 42. When the medium M contacts the guide rollers 49, the guide rollers 49 are driven to rotate. The plurality of guide rollers 49 are arranged in the width direction X.

As illustrated in FIGS. 4 and 5, in the medium guide mechanism 46, a plurality of pressing members 81 are arranged at intervals in the width direction X. The pressing members 81 press the medium M being transported against the medium holding member 50. As illustrated in FIG. 5, the pressing members 81 are biased by an elastic member 82 to pivot around a shaft 471 toward a pressing direction PD toward which contact portions 815 of end portions of the pressing members 81 press a front surface of the medium M being transported. The contact portions 815 of the pressing members 81 press the medium M in such a manner that the medium M is positioned under a nipping point N1 of the transport roller set 41 and the holding surfaces 50A. The pressing members 81 press the front surface of the medium M at positions between which the first ribs 51 are present in the width direction X. This causes the medium M being transported to be curved and have a waveform shape in the width direction X and to alternately have a rising slope and a falling slope in the width direction X. Therefore, for example, when the medium M is normal paper with relatively low rigidity or the like and is curved and has a waveform shape in the width direction X, tensile force in the transport direction Y0 is applied to the medium M. The tensile force suppresses the rising of a front end of the medium M. For example, the tensile force suppresses contact of the front end of the medium M with the nozzle surface 25A.

A process of transporting the medium M from the start of recording to the end of the recording includes a first transport process in which the medium M is nipped by only the transport roller set 41, a second transport process in which the medium M is nipped by the transport roller set 41 and the discharge roller set 42, and a third transport process in which the medium M is nipped by only the discharge roller set 42.

At the time of separation of a rear end Mb of the medium M from the nipping point N1 of the transport roller set 41, kicking occurs. In the kicking, the transport driving roller 410 pushes the rear end Mb of the medium M. Even when the medium M is transported at a fixed speed and kicked, a reduction in the accuracy of a stop position due to the kicking hardly occurs. On the other hand, when the speed of the medium M is reduced from a fixed speed and the medium M is almost stopped and receives kicking force, a stop position of the medium M significantly deviates from a target position.

The kicking of the medium M may not enable the medium M to be stopped at a next target recording position and may cause an actual next recording position to significantly deviate downstream from the target position in the transport direction Y0. In the embodiment, before the rear end Mb of the medium M reaches a position near the nipping point N1 where the rear end Mb receives kicking force, correction transport control is performed to correct a feeding amount of the medium M in advance and avoid the medium M being stopped at a position where the rear end Mb of the medium M easily receives kicking force. The correction transport control is described later in detail.

Electric Configuration of Recording Device

Figure 6:
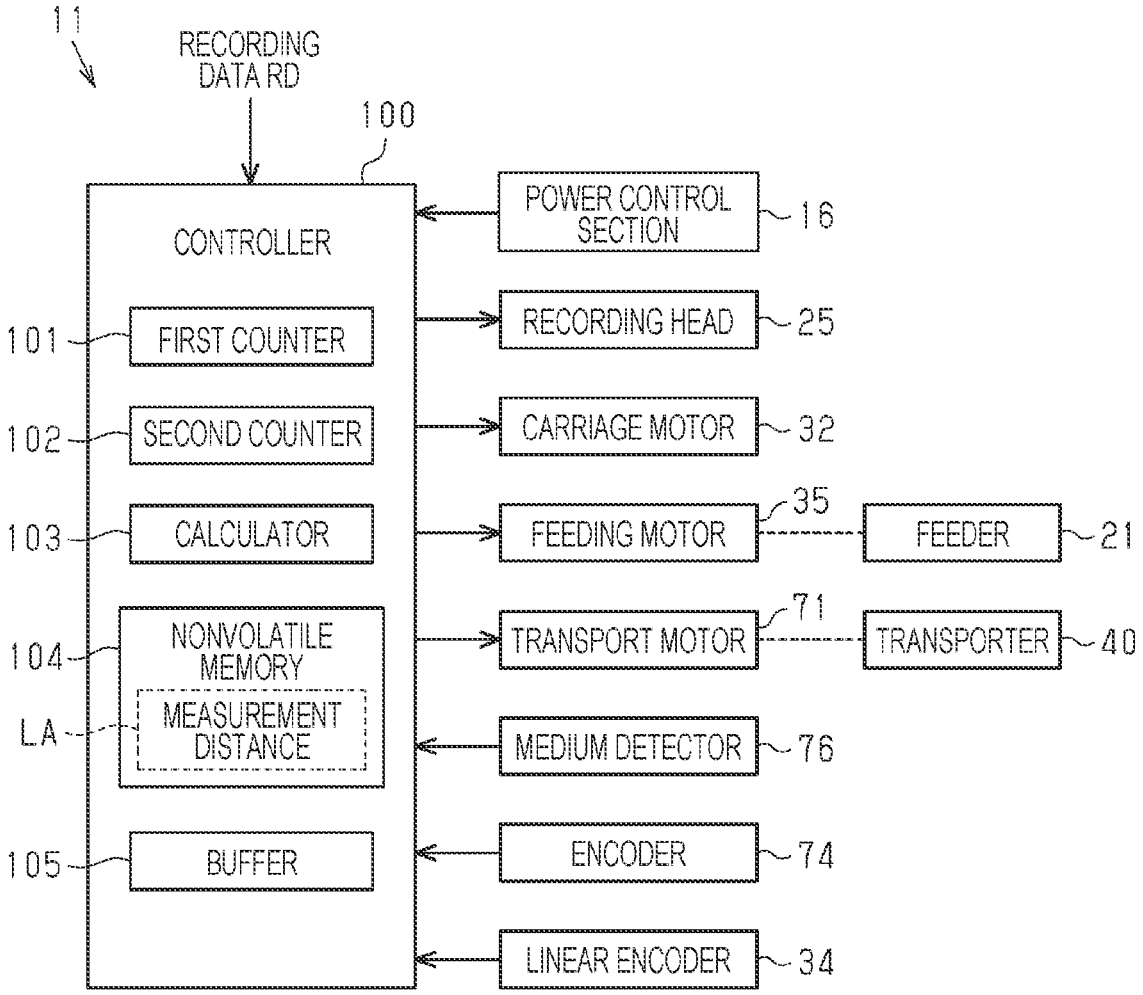
FIG. 6 is a block diagram illustrating an electric configuration of the recording device.

Next, an electric configuration of the recording device 11 is described with reference to FIG. 6. As illustrated in FIG. 6, the recording device 11 includes the controller 100. The controller 100 performs various types of control including recording control to be performed on the recording device 11. The controller 100 is not limited to a controller that performs software processing in all processes to be performed by the controller 100. For example, the controller 100 may include a dedicated hardware circuit (for example, an application specific integrated circuit (ASIC)) that performs hardware processing in one or more of the processes to be performed by the controller 100. Specifically, the controller 100 may be configured as circuitry including one or more processors that operate in accordance with a computer program (software), one or more dedicated hardware circuits that perform one or more of the various processes, or a combination thereof. The processor includes a CPU and a memory including a RAM and a ROM. The memory stores a program code configured to cause the CPU to execute the processes or an instruction to cause the CPU to execute the processes. The memory is a computer-readable medium and includes a medium accessible by a general-purpose or dedicated computer and able to be used by the general-purpose or dedicated computer in various ways.

As illustrated in FIG. 6, the recording head 25, the carriage motor 32, the feeding motor 35, and the transport motor 71 are electrically coupled to the controller 100 and serve as an output system. The controller 100 controls the recording read 25, the carriage motor 32, the feeding motor 35, and the transport motor 71.

The power control section 16, the medium detector 76, the encoder 74, and the linear encoder 34 are electrically coupled to the controller 100. The power control section 16 and the medium detector 76 serve as an input system. The encoder 74 and the linear encoder 34 serve as a transport system. The medium detector 76 is present upstream of a scan region of the recording head 25 in the transport direction Y0 and detects whether the medium M is present at a predetermined position on the transport path. The medium detector 76 outputs a medium detection signal MS to the controller 100.

The controller 100 detects the front end of the medium M based on the switching of the medium detection signal MS received from the medium detector 76 from a non-detection signal indicating that the medium M has not been detected to a detection signal indicating that the medium M has been detected. The controller 100 detects the rear end Mb of the medium M based on the switching of the medium detection signal MS received from the medium detector 76 from the detection signal indicating that the medium M has been detected to the non-detection signal indicating that the medium M has not been detected.

The encoder 74 of the transport system outputs the detection pulse signal ES (refer to FIG. 8) including the number of pulses proportional to a rotational amount of the transport driving roller 410 included in the transport roller set 41. The linear encoder 34 includes the linear scale (not illustrated) and the optical sensor attached to the carriage 24. When the optical sensor optically reads the linear scale, the linear encoder 34 outputs a detection signal constituted by a pulse signal including the number of pulses proportional to the amount of movement of the recorder 23.

As illustrated in FIG. 6, the controller 100 includes a first counter 101, a second counter 102, a calculator 103, a nonvolatile memory 104, and a buffer 105. The first counter 101 treats, as an original position, the position of the medium M when the front end of the medium M fed by the feeder 21 is detected by the medium detector 76. The first counter 101 counts a value indicating a transport position y corresponding to the position of the front end of the medium M in the transport direction Y0 or to the position of the rear end Mb of the medium M in the transport direction Y0.

Specifically, when the medium detector 76 detects the front end of the medium M or the rear end Mb of the medium M, the first counter 101 is reset. The first counter 101 counts the number of pulse edges of the detection pulse signal ES (refer to FIG. 8) input from the encoder 74 that has detected a rotational amount of the transport driving roller 410 of the transport roller set 41. Therefore, the value counted by the first counter 101 indicates the position of the front end of the medium M in the transport direction Y0 or indicates the position of the rear end Mb of the medium M in the transport direction Y0. The controller 100 controls the motors 35 and 71 of the transport system based on the value counted by the first counter 101, thereby controlling the feeding, transport, and discharge of the medium M.

When the front end of the medium M is detected by the medium detector 76, the controller 100 resets the first counter 101 and counts the number of pulse edges of the detection pulse signal ES from the encoder 74, and the value counted by the first counter 101 indicates the position of the front end of the medium M transported in the transport direction Y0. When the rear end Mb of the medium M is detected by the medium detector 76, the controller 100 resets the first counter 101 and counts the number of pulse edges of the detection pulse signal ES from the encoder 74, and the value counted by the first counter 101 indicates the position of the rear end Mb of the medium M transported in the transport direction Y0.

The second counter 102 treats the home position HP of the carriage 24 as an original point and counts a value indicating a carriage position corresponding to the position of the carriage 24 in the scan direction X. When the carriage 24 reaches an original position where the carriage 24 is in contact with a restriction surface (not illustrated) present on the home position HP side, the second counter 102 is reset. Whether the carriage 24 reaches the original position where the carriage 24 is in contact with the restriction surface is determined based on a change in a current value of the carriage motor 32. The second counter 102 counts the number of pulse edges of a pulse signal input from the linear encoder 34. Therefore, the value counted by the second counter 102 indicates the position (carriage position) of the carriage 24 in the scan direction X, while the original position of the carriage 24 is treated as a standard. The controller 100 controls the carriage motor 32 based on the value counted by the second counter 102, thereby controlling the speed of the recorder 23 and the position of the recorder 23.

The nonvolatile memory 104 stores various programs, various types of setting data, and the like. The controller 100 has a measurement mode in which a measurement distance LA that is a distance from a detection position SP (refer to FIG. 7) to a nipping position NP on the transport path is measured. The detection position SP is a position where the front end of the medium M and the rear end Mb of the medium M are detected by the medium detector 76. The nipping position NP corresponds to the nipping point N1 of the transport roller set 41. The controller 100 causes the measurement distance LA measured in the measurement mode to be stored in a predetermined region of the nonvolatile memory 104.

The controller 100 performs the correction transport control to suppress a reduction in the accuracy of the transport position of the medium M that is caused by the kicking of the rear end Mb of the medium M by the transport roller set 41. The measurement distance LA is used for the correction transport control. The correction transport control changes a stop position of the medium M to a stop position of the medium M stopped in a state in which the rear end Mb is not present in a kicking region KA. Specifically, the controller 100 predicts whether the medium M is stopped in a state in which the rear end Mb is present in the kicking region KA.

The controller 100 judges whether the rear end Mb that is an upstream end of the medium M in the transport direction Y0 crosses the kicking region KA set in a range present downstream of the nipping position NP of the transport roller set 41 in the transport direction Y0 and shorter than the minimum feeding amount a of the medium M. When the controller 100 judges that the rear end Mb does not cross the kicking region KA, the controller 100 adjusts the feeding amount for at least one of a plurality of transport operations to be performed after the rear end Mb of the medium M is detected by the medium detector 76 and until the rear end Mb reaches the kicking region KA in such a manner that the rear end Mb of the medium M crosses the kicking region KA. In the embodiment, after the rear end Mb of the medium M is detected by the medium detector 76, the controller 100 judges whether the rear end Mb crosses the kicking region.

By adjusting the feeding amount of the medium M in an operation of transporting the medium M (upstream) before the rear end Mb reaches the nipping point N1, the controller 100 controls the transport of the medium M in such a manner that the rear end Mb of the medium M crosses the kicking region KA in a subsequent transport operation.

The controller 100 receives a recording job together with recording data RD. The received recording data RD is temporarily stored in the buffer 105. The recording data RD includes various commands necessary for recording control and image data to be used to perform the recording control on the recording head 25. The commands include a transport command to specify a feeding amount of the medium M. The controller 100 performs the recording control on the recording head 25 by transmitting image data to the recording head 25 for each pass.

A storage capacity of the buffer 105 varies depending on the type of the recording device 11. The buffer 105 may have a storage capacity for a plurality of passes or have a storage capacity for one page. When the buffer 105 has a storage capacity for a plurality of passes, that are a number k of passes, and a pass currently executed is treated as a standard, feeding amounts for transport operations for the first to k−1-th passes can be acquired, but feeding amounts for transport operations for the k-th and subsequent passes cannot be acquired. On the other hand, when the buffer 105 has a storage capacity for one page, feeding amounts can be acquired for all passes to be performed on one page.

Next, the cause of a reduction in the accuracy of the transport position of the medium M is described with reference to FIGS. 7 and 8.

At the time of release of the rear end Mb of the medium M from a nipped state in which the rear end Mb is nipped by the transport roller set 41, kicking occurs in the recording device 11 according to the embodiment. In the kicking, the transport roller set 41 pushes the medium downstream in the transport direction Y0. The kicking may cause the transport position of the medium M to deviate from a target position and reduce the accuracy of a recording position.

Figure 7:
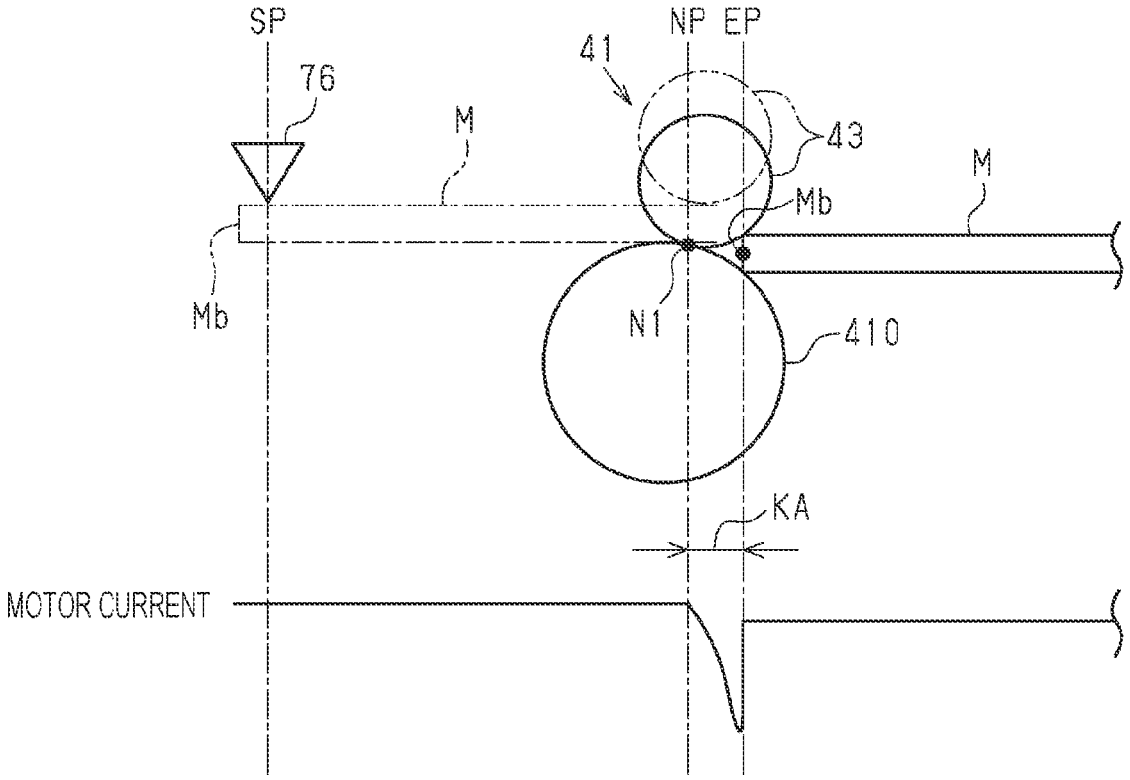
FIG. 7 is a schematic diagram illustrating relationships between kicking of a medium and a motor current of a transport motor.

FIG. 7 illustrates a process of transporting the medium M until the rear end Mb of the medium M passes through the detection position SP of the medium detector 76 and crosses the nipping point N1 of the transport roller set 41, and a motor current, corresponding to the position of the rear end Mb, of the transport motor 71. When the medium M is intermittently transported, the motor current actually has a trapezoidal waveform. However, in FIG. 7, when the medium M is intermittently transported, the motor current has a schematic waveform that corresponds to a fixed speed of the medium M and in which waveform's parts corresponding to acceleration and deceleration of the medium in the intermittent transport are ignored. Motor currents illustrated in FIGS. 9 and 11 have the same schematic waveform.

During the time when the medium M indicated by a dashed-and-double-dotted line in FIG. 7 is nipped and transported by the transport roller set 41, a predetermined motor current corresponding to a transport load of the medium M flows in the transport motor 71. After that, the medium M is kicked by the transport roller set 41 at the time of separation of the rear end Mb from the nipping point N1. Not only the rotational force of the transport roller set 41 but also biasing force that biases the transport driven rollers 43 downward cause kicking force. When the medium M is kicked, the transport load, applied to the transport motor 71, of the medium M temporarily significantly drops or temporarily drops to zero and thus a large falling peak of the motor current occurs. When the transport position y is indicated by a positional coordinate in the transport direction Y0, the transport position y corresponding to the lowest point Imin of the peak of the motor current corresponds to a release position EP where the medium M is separated from an outer circumferential surface of the transport driving roller 410 and outer circumferential surfaces of the transport driven rollers 43 and is completely released from the transport roller set 41.

The peak of the motor current reflects the kicking force received by the medium M from the transport roller set 41. The medium M receives the kicking force from the transport roller set 41 when the medium M is present in a region between the nipping position NP corresponding to the nipping point N1 and the release position EP. The region in which the medium M receives the kicking force is the kicking region KA. The distance between the nipping position NP and the release position EP depends on a thickness of the medium M. Therefore, when the release position EP and the thickness of the medium M are determined, the nipping position NP can be identified. The nipping position NP may vary depending on an individual difference of the recording device 11 from other recording devices. In the embodiment, a sensor is not installed to measure the nipping position NP. In the embodiment, when the medium M is transported, a change in the motor current that is caused by the kicking at the time of release of the medium M from the nipping by the transport roller set 41 is detected, and the nipping position NP is measured based on the transport position y when the change is detected.

Figure 8:
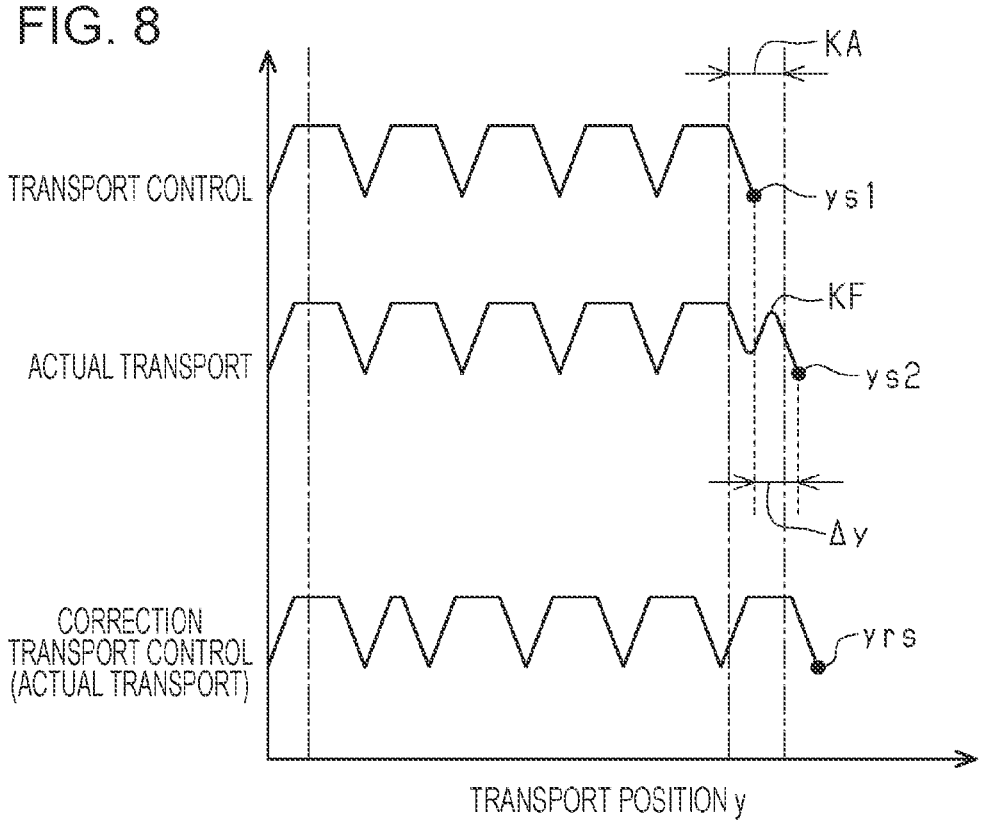
FIG. 8 is a graph illustrating comparison of waveforms indicating transport speeds at which the medium is transported until a rear end of the medium enters in or passes through a kicking region.

FIG. 8 illustrates an example of comparison of a waveform indicating a transport speed at which the medium M is transported in the embodiment with waveforms indicating transport speeds at which the medium M is transported in comparative examples corresponding to conventional techniques. In a graph of the three speed waveforms illustrated in FIG. 8, a horizontal axis indicates a transport position y and a vertical axis indicates a transport speed. The two speed waveforms illustrated at the top and the second top among the three waveforms illustrated in FIG. 8 indicate the comparative examples, while the speed waveform illustrated at the bottom in FIG. 8 indicates the embodiment. The speed waveform illustrated at the top is a control speed waveform to be used for control by a controller 100 according to the comparative example. Specifically, the speed waveform illustrated at the top is a target speed waveform for transport control by the controller 100 according to the comparative example. Since the medium M is intermittently transported, the target speed waveform has a plurality of repetitive trapezoidal waves. The medium M is stopped in each of transport operations. The controller 100 according to the comparative example controls a transport motor 71 based on the speed waveform for the transport control. For example, it is considered that an image, such as a photographic image, is recorded on the medium M. In the image recording that does not form a blank line in the middle of the recording, the controller 100 according to the comparative example intermittently transports the medium M by the minimum feeding amount for each pass. The comparative example illustrated at the top in FIG. 8 indicates that the medium M is stopped in a state in which the rear end Mb is positioned in a kicking region KA.

The speed waveform illustrated at the second top in FIG. 8 is a speed waveform of the medium M that is actually transported by controlling the transport motor 71 by the controller 100 in accordance with the target speed waveform illustrated at the top in FIG. 8. In this case, based on the speed waveform for the transport control, the medium M is almost stopped in a state in which the rear end Mb is positioned in the kicking region KA. However, the medium M receives kicking force KF from a transport roller set 41 immediately before the stop of the medium M. As a result, the medium M is stopped at an actual stop position ys2 deviating downstream from a target position ys1 in a transport direction Y0. Therefore, there is a deviation Δy between the target position ys1 and the actual stop position ys2.

The speed waveform illustrated at the bottom in FIG. 8 indicates a speed waveform for the correction transport control that reduces the deviation Δy. The correction transport control is performed to adjust the feeding amount of the medium M in such a manner that the rear end Mb of the medium M crosses the kicking region KA. According to the speed waveform for the correction transport control, after the rear end Mb is detected by the medium detector 76, the feeding amount for at least one of a plurality of transport operations to be performed until the rear end Mb passes through the nipping point N1 of the transport roller set 41 is adjusted. In the example illustrated in FIG. 8, the feeding amount for a transport operation to be performed for the first time after the rear end Mb is detected by the medium detector 76 is adjusted to an amount smaller than the feeding amount. As a result of the correction transport control, the rear end Mb of the medium crosses the kicking region KA and is stopped at a target position yrs.

To perform the correction transport control, the controller 100 judges whether the rear end Mb of the medium M crosses the kicking region KA. When the controller 100 judges that the rear end Mb does not cross the kicking region KA, the controller 100 adjusts the feeding amount for a transport operation in advance before the rear end Mb reaches the kicking region KA.

Therefore, before the rear end Mb passes through the nipping position NP, the controller 100 performs simulation calculation to estimate whether the rear end Mb crosses the kicking region KA. When the controller 100 judges that the rear end Mb does not cross the kicking region KA and is stopped at a position within the kicking region KA, the controller 100 performs the correction transport control. In the simulation calculation, the measurement distance LA (refer to FIG. 9) that is a measured distance from the detection position SP to the nipping position NP on the transport path is used. The recording device 11 according to the embodiment has the measurement mode in which the measurement distance LA is measured using a change in the motor current of the transport motor 71 when the medium M is transported.

Measurement Mode

Figure 9:
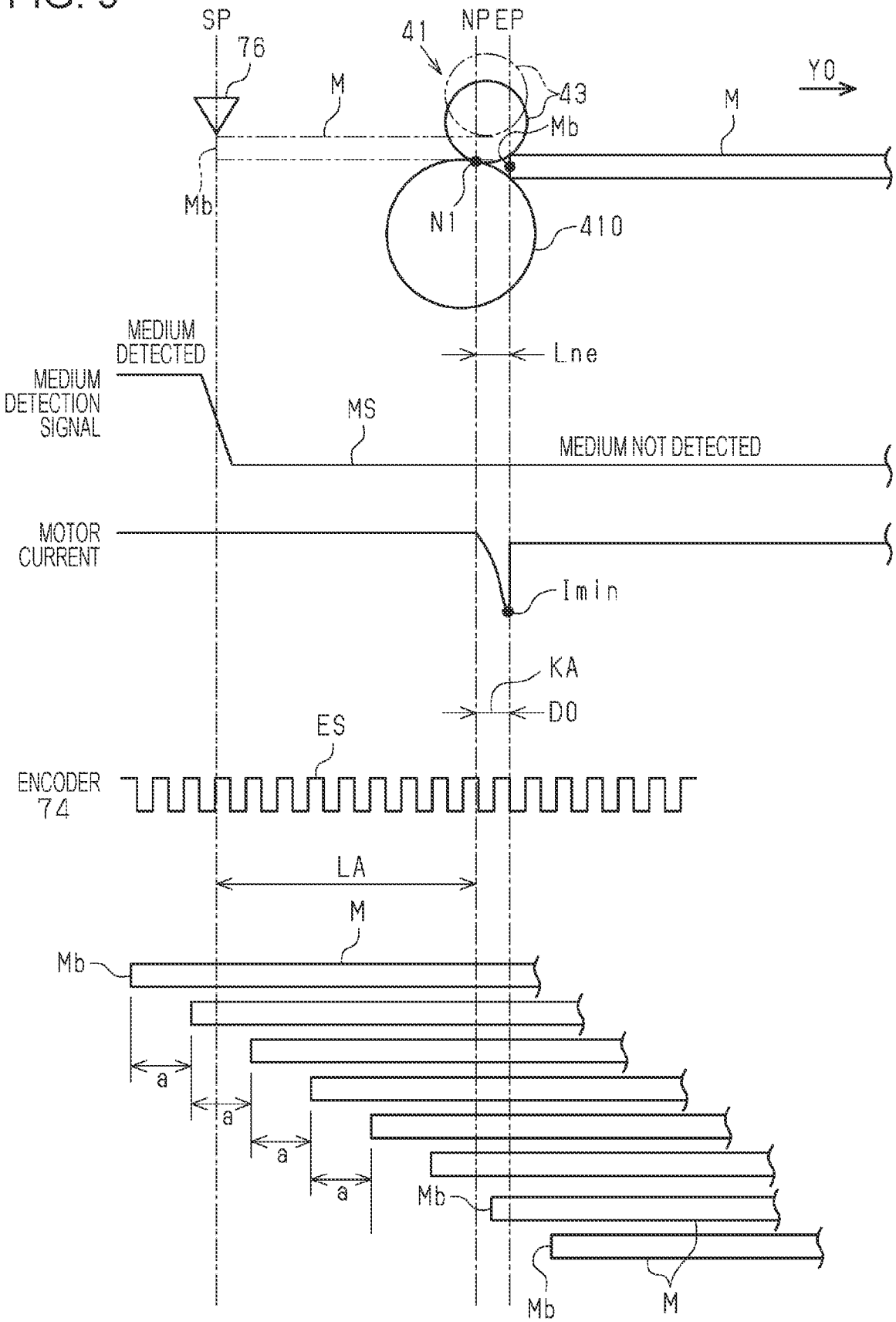
FIG. 9 is a schematic diagram illustrating a method for measuring a measurement distance between a detection position and a nipping position.

FIG. 9 illustrates a state in which the medium M is transported by the transport roller set 41 to measure the measurement distance LA in the measurement mode, the medium detection signal MS of the medium detector 76, the motor current of the transport motor 71, the detection pulse signal ES output by the encoder 74 of the transport system, and a state in which the medium M is transported by a predetermined amount for each pass.

As illustrated in FIG. 9, the rear end Mb of the medium M is detected by the medium detector 76 when the medium M is present at a position indicated by a dashed-and-double-dotted line in FIG. 9. The first counter 101 is reset based on the detection and counts the number of pulse edges of the detection pulse signal ES input from the encoder 74, for example. The first counter 101 uses, as a standard, the detection position SP where the medium detector 76 has detected the rear end Mb, and uses the detection pulse signal ES of the encoder 74 to count a value indicating the position of the rear end Mb of the medium M transported by the feeding amount a for each pass.

The transport of the medium M in the measurement mode may be performed as test recording to record a test pattern on the medium M or may be performed for only measurement. In the measurement mode illustrated in FIG. 9, the medium M may be intermittently transmitted or may be transmitted at a fixed transport speed for only measurement.

As illustrated in FIG. 9, for a time period for which the medium M indicated by the dashed-and-double-dotted line is nipped by the transport roller set 41, the medium M is transported at a fixed speed and the motor current remains at a fixed value. In this case, the controller 100 performs feedback control on the transport motor 71 to cause the transport motor 71 to remain at a fixed target speed. At the time of separation of the rear end Mb from the nipping point N1, the rear end Mb of the medium M is kicked by the transport roller set 41. At the time of the kicking, the motor current rapidly drops with a peak. During the time when the medium M is in contact with the outer circumferential surface of the transport driving roller 410 and the outer circumferential surfaces of the transport driven rollers 43 after the rear end Mb of the medium M passes through the nipping point N1, the medium M receives kicking force from the transport roller set 41. When the rear end Mb is separated from the outer circumferential surface of the transport driving roller 410 and the outer circumferential surfaces of the transport driven rollers 43, the motor current increases toward the original value and recovers. The value of the motor current after the recovery is slightly smaller than the original value before the occurrence of the peak, since the transport roller set 41 does not nip the medium M and the transport load applied to the transport motor 71 is reduced for the non-nipping.

During the time when the transport roller set 41 nips and transports the medium M, a predetermined motor current corresponding to the transport load of the medium M flows in the transport motor 71. After that, when the medium M is kicked by the transport roller set 41 at the time of separation of the rear end Mb of the medium M from the nipping point N1, the transport load, applied to the transport motor 71, of the medium M temporarily significantly drops or temporarily drops to zero and thus the motor current rapidly significantly drops with a peak. The transport position y corresponding to the lowest point Imin of the peak of the motor current corresponds to the release position EP where the medium M is separated from the outer circumferential surface of the transport driving roller 410 and the outer circumferential surfaces of the transport driven rollers 43. The release position ES depends on the thickness of the medium M. Therefore, when the medium M is a first medium M that has a small thickness and is normal paper or the like, a distance Lne from the nipping position NP to the release position EP is short due to the thickness of the medium M. On the other hand, when the medium M is a second medium M that has a large thickness and is dedicated paper, such as photo paper, the distance Lne from the nipping position NP to the release position ES is long due to the thickness of the medium M.

The first medium M that is thin and is normal paper or the like can absorb some force applied due to the kicking, since the medium M becomes bent upon being kicked. However, the second medium M that is dedicated paper, such as photo paper, hardly becomes bent, compared to the first medium M. Therefore, the second medium M easily has an effect of the kicking. In addition, since a higher recording quality is requested for the second medium M, compared to the first medium M, higher accuracy of the transport position is requested for the second medium M, compared to the first medium M. Therefore, for example, the recording device 11 may have a configuration in which the correction transport control is performed for recording to be performed on the second medium M, such as dedicated paper, and is not performed for recording to be performed on the first medium 1, such as normal paper. In this case, the second medium M2, such as dedicated paper, may be used to measure the measurement distance LA.

In the measurement mode, a known type of a medium M having a known thickness is used. Specifically, in the measurement mode, a medium M having a predetermined thickness is used, or information of a thickness of a medium M to be used or medium information that can identify the thickness of the medium is input to the controller 100 by operating the control panel 15 or a keyboard of a host device (not illustrated) or the like. The medium information that can identify the thickness of the medium includes medium type information indicating a medium type, such as "normal paper", "thick paper", or "photo paper". When the information of the thickness of the medium M is determined, the distance Lne, corresponding to the thickness information, between the nipping position NP and the release position EP is determined.

In the measurement mode, the first counter 101 reset when the rear end Mb of the medium M is detected by the medium detector 76 counts the number of pulse edges of the detection pulse signal ES input from the encoder 74 that has detected a rotational amount of the transport driving roller 410. Therefore, the value counted by the first counter 101 indicates the position of the rear end Mb of the medium M on the transport path, while the detection position SP is treated as the original point.

The controller 100 monitors the motor current of the transport motor 71 and detects the lowest point Imin of a peak appearing after the rear end Mb is detected by the medium detector 76 in the measurement mode. Then, the controller 100 identifies the release position EP from the position of the detected lowest point Imin. In the nonvolatile memory 104, table data (not illustrated) indicating relationships between the thickness of the medium M and the distance Lne is stored. The controller 100 references the table data based on the information of the known thickness of the medium M and acquires the distance Lne associated with the thickness of the medium M. The controller 100 calculates, as the nipping position NP, a position separated from the release position EP upstream of the release position EP by the distance Lne associated with the thickness of the medium M used for the measurement. Specifically, the controller 100 calculates an equation of NP=EP−Lne, thereby calculating the nipping position NP corresponding to the nipping point N1. In this manner, the controller 100 detects a change in the current of the transport motor 71 at the time of passage of the rear end Mb of the medium M through the transport roller set 41 and sets the nipping position NP based on the result of the detection.

Next, the controller 100 uses the nipping position NP to calculate the measurement distance LA. Specifically, the controller 100 calculates the measurement distance LA from the detection position SP to the nipping position NP. In other words, the controller 100 calculates the measurement distance LA using an equation of LA=NP−SP. The controller 100 causes the calculated measurement distance LA to be stored in a predetermined storage region of the nonvolatile memory 104. The detection position SP is indicated by the value counted by the first counter 101 when the rear end Mb is detected by the medium detector 76 based on switching from a detection state in which the medium detector 76 has detected the medium M to a non-detection state in which the medium detector 76 has not detected the medium M. Therefore, the detection position SP is indicated by a value of 0 when the first counter 101 is reset. In other words, when the calculation is performed using a value corresponding to the counted value and using the detection position SP as the original point, the counted value indicating the nipping position NP is used as the measurement distance LA. In this manner, the controller 100 measures, based on the detection pulse signal ES output by the encoder 74, the distance from the detection position SP where the medium detector 76 has detected the rear end Mb of the medium M to a position where a change in the current of the transport motor 71 has been detected. Then, the controller 100 causes the measured distance to be stored as the measurement distance LA in the nonvolatile memory 104.

Instead of the measurement distance LA, the nipping position NP may be stored in the nonvolatile memory 104. The controller 100 may calculate the measurement distance LA at predetermined time based on positional information of the nipping position NP and positional information of the detection position SP where the medium detector 76 has detected the rear end Mb of the medium M. For example, the predetermined time may be when the user uses the recording device 11 to perform recording for the first time after purchasing the recording device 11 or may be when the recording device 11 performs recording on first paper for each recording job. The foregoing calculation is performed by the calculator 103 included in the controller 100.

In the measurement mode, when the medium M skews (or is inclined), a peak of the motor current is small and gentle, and a peak of kicking force may not be accurately reflected in the motor current. Therefore, when the medium M is transported in the measurement mode, a skewing prevention mechanism that prevents the medium M from skewing may be attached and may guide the medium M. Alternatively, when the magnitude of the peak of the motor current does not exceed a threshold, the controller 100 may determine that the medium M has skewed, and treat the skewing as an error of the measurement of the nipping position NP and the measurement distance LA. When the magnitude of the peak of the motor current exceeds the threshold, the controller 100 calculates the nipping position NP and the measurement distance LA based on the position of the lowest point Imin of the peak.

In the embodiment, the measurement distance LA is measured in the manufacturing of the recording device 11 before the shipment of the recording device 11 from a manufacturing factory. Specifically, the measurement distance LA is measured in advance in a process of inspecting the recording device 11 before the shipment and is stored in the predetermined storage region of the nonvolatile memory 104. In the nonvolatile memory 104 of the recording device 11 purchased by the user, data of the measurement distance LA is stored in advance.

The controller 100 has a first recording mode and a second recording mode. In the first recording mode, recording is performed at a first recording resolution. In the second recording mode, recording is performed at a second recording resolution higher than the first recording resolution. A length D0 of the kicking region KA in the transport direction Y0 may be set for each of the first and second recording modes in such a manner that the set length D0 of the kicking region KA in the first recording mode is different from the set length D0 of the kicking region KA in the transport direction Y0 in the second recording mode. In the embodiment, the first recording mode corresponds to a standard recording mode in which a recording speed is prioritized over a recording quality. The second recording mode corresponds to a high-definition recording mode in which a recording quality is prioritized over a recording speed. The minimum feeding amount a in the standard recording mode is different from the minimum feeding amount a in the high-definition recording mode. When the minimum feeding amount in the high-definition recording mode is amin, the minimum feeding amount in the standard recording mode is m*amin (m>1). For example, 1.5<m<3. In the embodiment, m=2. The length D0 of the kicking region KA may be set based on the minimum feeding amount in each of the recording modes.

The kicking region KA may be set to a region present separated downstream from the nipping position NP by the distance Lne in the transport direction Y0. However, when the minimum feeding amount a (a<D0) is a value that does not enable the medium M to cross the kicking region KA, the correction transport control is not established. Therefore, the length D0 of the kicking region KA is set to a value smaller than the minimum feeding amount a. In addition, as a result of an experiment, it is found that a position corresponding to the maximum value of a peak of kicking force is present slightly upstream of a position corresponding to the lowest point Imin of a peak of the motor current. Therefore, the length D0 of the kicking region KA is set in such a manner that a>D0 is satisfied and that D0≤Lne is satisfied. The controller 100 may monitor a motor voltage of the transport motor 71 instead of the motor current of the transport motor 71. Even when the controller 100 monitors the motor voltage, the nipping position NP, the measurement distance LA, and the kicking region KA can be set based on the position of the lowest point of a falling peak of the motor voltage in the same manner as the motor current. Therefore, in the embodiment, the motor current may be interpreted as the motor voltage. The controller 100 may detect a change in the motor voltage and calculate the nipping position NP and the measurement distance LA based on a result of detecting the change in the motor voltage.

The controller 100 may change the set length D0 of the kicking region KA in the transport direction Y0 based on the thickness of the medium M on which recording is to be performed by the recording head 25. The controller 100 identifies the thickness of the medium M based on the medium type information included in recording data RD. The controller 100 sets the length D0 of the kicking region KA based on the thickness of the medium M on which recording is to be performed. Therefore, in the embodiment, the length D0 of the kicking region KA is set based on the thickness of the medium M and a recording mode in which recording is to be performed on the medium M.

Figure 12:
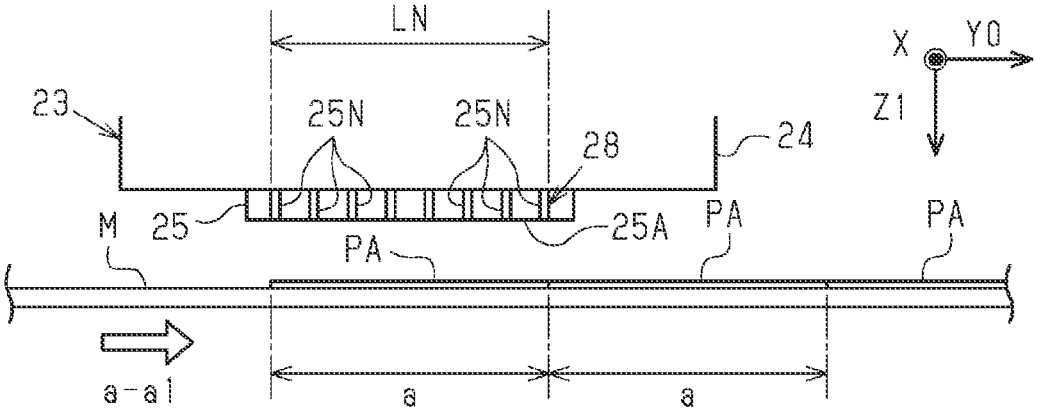
FIG. 12 is a schematic side view describing a recording operation performed on the medium before the medium is transported by the corrected feeding amount.

As illustrated in FIG. 12, the recording head 25 according to the embodiment includes a plurality of nozzles 25N (refer to FIG. 12) opened on the nozzle surface 25A (lower surface in the embodiment) that can be present opposite to the transport path. In the recording head 25, the nozzles 25N are arranged at predetermined nozzle pitches in the transport direction Y0. The number of nozzle strings 28, each of which is composed of a plurality of nozzles 25N, is the same as the number of colors. The nozzle strings 28 eject liquid drops (for example, ink drops) of colors, such as cyan (C), magenta (M), yellow (Y), and black (K). FIG. 12 illustrates only a nozzle string 28 for one color.

The recording head 25 ejects liquid drops LQ (refer to FIG. 14) from the nozzles 25N to perform recording on the medium M for one pass. Specifically, the recording head 25 ejects liquid drops LQ from the nozzles 25N to perform recording on the medium M for one pass in a process of moving the carriage 24 in the scan direction X. For example, in a band recording method in which all the nozzles 25N are used to perform recording, a band-shaped recording layer PA is repeatedly formed on the surface of the medium M in the transport direction Y0. There is a microwave recording method different from the band recording method. In the microwave recording method, some of the nozzles are used to perform recording while the medium is transported by a feeding amount smaller than that in the band recording method in such a manner that recorded dot strings adjacent to each other in the transport direction Y0 are not formed by nozzles adjacent to each other to prevent a variation in formation positions of the nozzles from being reflected as a variation in recording positions. When the band recording method is a first recording method and the microwave recording method is a second recording method, the minimum feeding amount in the second recording method is smaller than the minimum feeding amount in the first recording method. For example, the first recording method is used in the standard recording mode and the second recording method is used in the high-definition recording mode. Therefore, the minimum feeding amount a is switched based on the recording mode.

Next, the correction transport control is described with reference to FIG. 10. The correction transport control is performed in recording performed on the medium M by the recording device 11 purchased by the user and including the nonvolatile memory 104 having stored therein the measurement distance LA measured as described with reference to FIG. 9.

Figure 10:
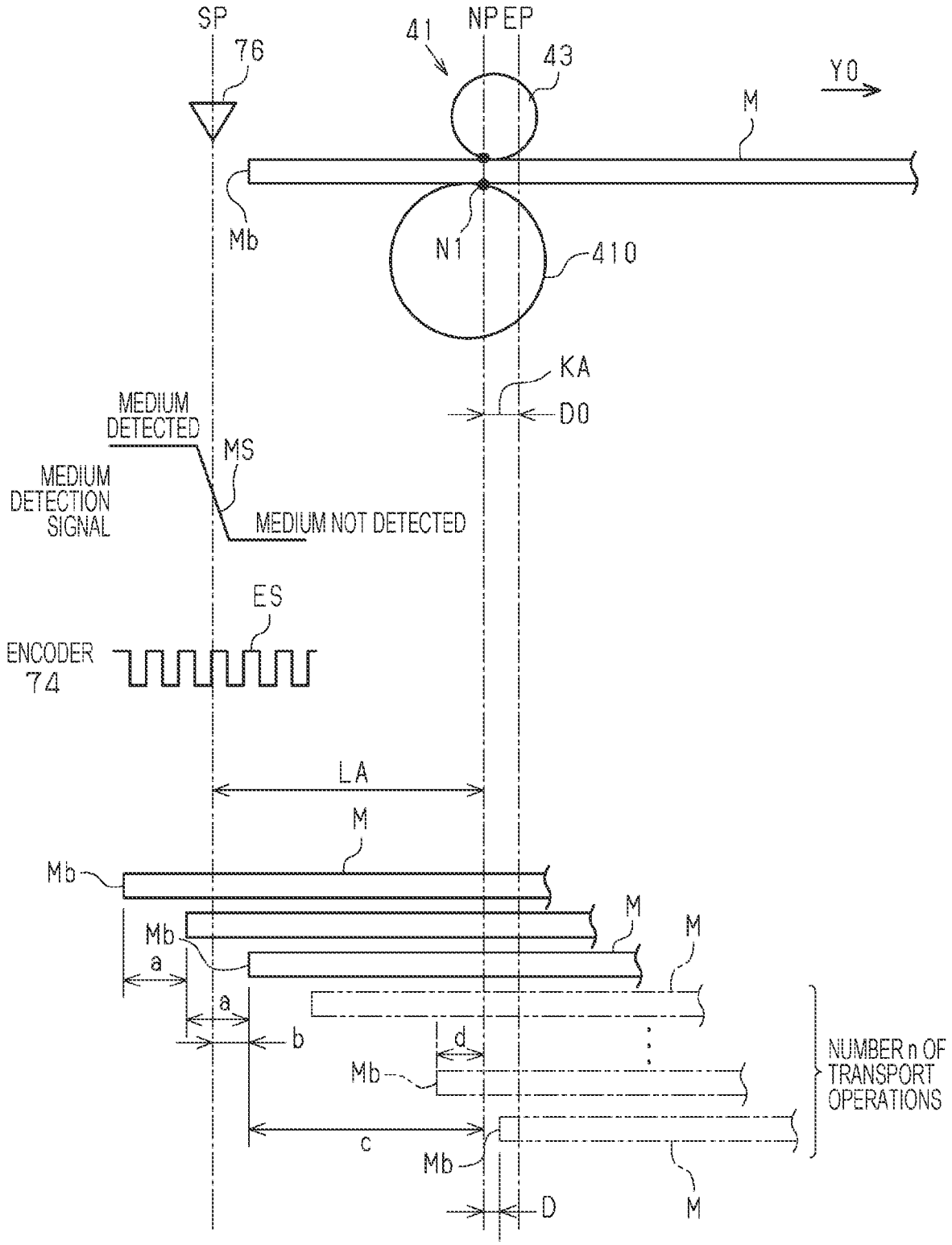
FIG. 10 is a schematic diagram describing a method for calculating a corrected feeding amount in correction transport control.

As illustrated in FIG. 10, the feeding amount for one pass in recording to be performed on the medium M is "a", and a remaining feeding amount of a transport operation that causes the rear end Mb to pass through the detection position SP where the medium detector 76 has detected the rear end Mb of the medium M is "b". The remaining feeding amount b is a distance from the detection position SP to the rear end Mb of the medium M. A remaining distance from the rear end Mb of the medium M transported by the remaining feeding amount b and stopped to the nipping position NP is "c". The remaining distance c is expressed by an equation of c=LA−b.

For example, in photographic printing to record a photographic image on photo paper, each transport operation is performed to transport the medium M by the minimum feeding amount a in the high-definition recording mode. The calculator 103 of the controller 100 calculates c/a. A quotient of c/a indicates the number of transport operations to be performed to transport the medium M by the remaining distance c. In this case, the number of transport operations is n−1 that is smaller by 1 than a number n of transport operations to be performed until the rear end Mb passes through the nipping position NP. A remaining distance d illustrated in FIG. 10 and corresponding to a remainder of c/a corresponds to a remaining distance from the rear end Mb of the medium M when the number n−1 of transport operations are completed to the nipping position NP. A distance D (=a−d) obtained by subtracting the remaining distance d from the feeding amount a for one transport operation indicates a distance from the nipping position NP to the rear end Mb of the medium M stopped when the n-th transport operation is completed. The calculator 103 calculates the distance D. When the distance D is longer than the set length D0 of the kicking region KA, it is found that the medium M crosses the kicking region KA in one transport operation.

The controller 100 treats the set length D0 of the kicking region KA as a threshold and judges whether the distance D exceeds the threshold D0 (or whether D>D0 is established). Specifically, the controller 100 judges whether the rear end Mb of the medium M can cross the kicking region KA in one transport operation. When the controller 100 judges that the rear end Mb cannot cross the kicking region KA in one transport operation (D<D0 is established), the controller 100 performs the correction transport. The controller 100 adjusts the feeding amount for at least one of the number n of transport operations to be performed until the rear end M is stopped at a position within the kicking region KA. In this case, the controller 100 may adjust the feeding amount to increase or reduce the feeding amount. In the embodiment, the controller 100 adjusts the feeding amount to an amount smaller than the original feeding amount for one transport operation.

The reason that the feeding amount is corrected to a smaller amount is as follows. A length of a region in which all the nozzles 25N constituting the nozzle strings 28 in the recording head 25 are arranged in the transport direction Y0 is a nozzle length LN (refer to FIG. 12). For example, in the band recording method illustrated in FIG. 12, the feeding amount a is nearly equal to the nozzle length LN. Thus, when the feeding amount a is adjusted to a longer amount, an unrecorded portion passes through a recording region present opposite to the nozzles 25N, and a white portion on which recording is not performed is present between a previous recording layer PA and a current recording layer. Therefore, by correcting the feeding amount a to a shorter amount, a continuous recording layer can be formed in such a manner that a white portion is not present between a previous recording layer PA and a current recording layer. For this reason, in the embodiment, as illustrated in FIG. 11, the feeding amount a for at least one of the number n of transport operations is adjusted to a corrected feeding amount of a−a1 that is shorter by an adjustment amount a1 than the feeding amount a. The adjustment amount a1 is D+α, where α is a margin. In other words, a1=a−d+α, where d is the remainder of c/a=(LA−b)/a. The controller 100 adjusts the feeding amount a using the adjustment amount a1 based on the measurement distance LA and the remaining feeding amount b of the transport operation that causes the rear end Mb to pass through the detection position SP where the medium detector 76 has detected the rear end Mb. The remaining feeding amount b is the distance from the detection position SP to the rear end Mb.

Figure 13:
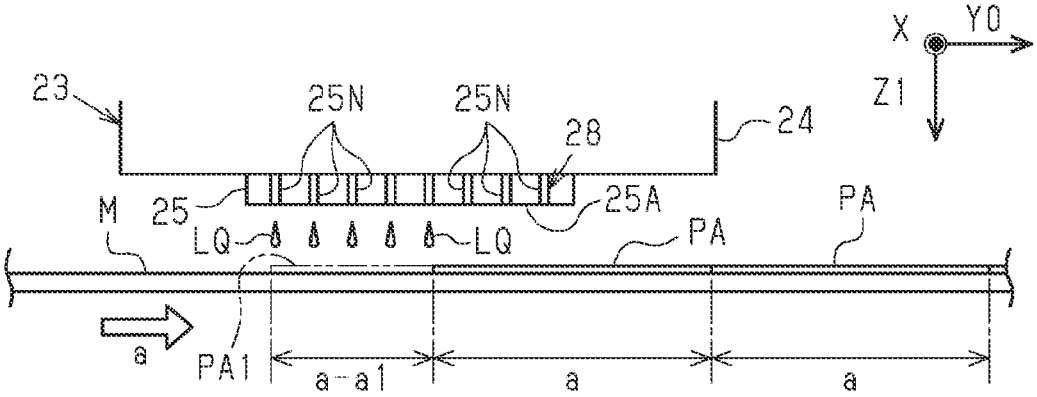
FIG. 13 is a schematic side view describing a recording operation performed on the medium transported by the corrected feeding amount.

As illustrated in FIG. 13, when the medium M is transported by the corrected feeding amount of a−a1, nozzles 25N that are among all the nozzles 25N and present downstream in the transport direction Y0 are positioned opposite to the previous recording layer PA and are not used for current recording. The controller 100 uses, for recording, nozzles 25N that are among all the nozzles 25N and present upstream in the transport direction Y0 and opposite to an unrecorded portion of the medium M. In this case, the controller 100 allocates an image continuous to a previously recorded image to nozzles 25N that are among all the nozzles 25N and present upstream in the transport direction Y0. Specifically, the controller 100 shifts the image continuous to the previously recorded image by the adjustment amount a1 upstream in the transport direction Y0 and allocates the image to nozzles 25N that are among all the nozzles 25N and present at positions corresponding to the position of the shifted image. The image is a recording image of a CMYK color system. Each of pixels of the image corresponds to one dot that is formed by ejecting a liquid drop from a nozzle 25N once.

After nozzles 25N to be used for a next recording operation based on the adjustment of the feeding amount and an image to be allocated to the nozzles to be used are adjusted (shifted), liquid drops LQ are ejected from the concerned nozzles 25N. As a result, an image in which an upstream end of a recording layer PA recorded in a previous pass is appropriately continuous to a downstream end of a recording layer PA1 recorded in a current pass immediately after a transport operation of transporting the medium by the corrected feeding amount of a−a1 is formed on the medium M. One or two dots of the recording layer PA recorded in the previous pass may overlap one or two dots of the recording layer PA1 recorded in the current pass. In this manner, the controller 100 adjusts a recording region on the medium M in the transport direction Y0 based on the adjustment amount for the feeding amount in a recording operation performed on the medium M by the recording head 25 immediately after a transport operation for which the feeding amount has been adjusted.

In a recording mode in which a recording layer PA previously recorded and a recording layer PA recorded after current correction transport can be continuously drawn even when the feeding amount a is corrected to a longer amount than the feeding amount a or in a recording device of a device type corresponding to the recording mode, the feeding amount may be adjusted to a longer amount than the feeding amount. For example, in a recording mode in which some of all the nozzles 25N are used to perform recording or in a recording device of a device type corresponding to the recording mode, images can be continuously drawn by using the nozzles and an available nozzle to eject liquid drops without forming a white portion in a recording operation immediately after an operation of transporting the medium by the corrected feeding amount.

For example, when the medium M is transported by a feeding amount shorter than the nozzle length LN or equal to ½, ⅓, or the like of the nozzle length LN, and the feeding amount a is adjusted to a corrected feeding amount a+a1, the previous recording layer PA and the current recording layer PA1 can be formed using nozzles 25N that were not used before in such a manner that a white portion is not present between the previous recording layer PA and the current recording layer PA1. In a recording mode in which an available nozzle is present downstream of nozzles 25N in use in the transport portion Y0 or in a recording device of a device type corresponding to the recording mode, the feeding amount may be adjusted to a longer amount than the feeding amount.

The recording device 11 may be of a certain device type (hereinafter referred to as "first device type") and have the buffer 105 in which only recording data RD for a number k (for example, k=2, 3, or 4) of passes can be recorded. Alternatively, the recording device 11 may be of another device type (hereinafter referred to as "second device type") and have the buffer 105 in which recording data RD for one page can be recorded.

Case where Device is of First Device Type

When the recording device 11 is of the first device type, recording data RD corresponding to the number k of passes is temporarily stored in the buffer 105. When the medium M is stopped for the first time after the rear end Mb passes through the detection position SP, and the recording device 11 already receives the necessary recording data RD, the recording device 11 makes the determination at the time of the stop of the medium M. However, at the time of the stop of the medium M, the recording device 11 may not yet receive the necessary recording data RD. In this case, it is not found that all the number n of transport operations are to transport the medium M by the same feeding amount a. As a first method, the controller 100 predicts that all the number n of transport operations are to transport the medium M by the same feeding amount a, and judges whether the rear end Mb crosses the kicking region KA (whether D≥D0). For example, in photographic printing, feeding amounts for all passes are highly likely to be equal to the minimum feeding amount a. In a second method, the controller 100 waits to make the determination until the controller 100 receives recording data RD including a transport command to cause the rear end Mb to pass through the nipping position NP. When the controller 100 receives the concerned recording data RD, the controller 100 judges, based on the concerned recording data RD, whether the rear end Mb crosses the kicking region KA by several transport operations, for example, one to three subsequent transport operations. When the controller 100 judges, based on the recording data RD, that the rear end Mb does not cross the kicking region KA (or D≤D0 is established), the controller 100 adjusts the feeding amount for at least one of a number n1 (n1<n) of transport operations to be performed from a transport operation to be performed immediately after the determination to a transport operation that causes the rear end Mb to be stopped in the kicking region KA. The controller 100 may acquire information of a transport command for one page as well as the recording data RD, and makes the determination when the rear end Mb is detected by the medium detector 76 and the medium M is stopped.

Case where Device is of Second Device Type

When the rear end Mb passes through the detection position SP and the controller 100 transition to a process of counting a value indicating the transport position y of the medium M using the position of the rear end Mb as a standard, the controller 100 judges whether the rear end Mb crosses the kicking region KA. Specifically, the calculator 103 calculates the distance D by subtracting, from the feeding amount a, the remainder d of c/a that divides the remaining distance c between the rear end Mb of the medium M and the nipping position NP by the feeding amount a. The controller 100 judges whether the calculated distance D exceeds the threshold D0 (whether D>D0 is established). When the distance D is equal to or smaller than the threshold D0 (D≤D0), the controller 100 adjusts the feeding amount a.

Next, effects of the recording device 11 are described. The measurement distance LA is measured in the inspection before the shipment of the recording device 11. After that, the user who has purchased the recording device 11 uses the recording device 11 to perform recording on the medium M. In this case, in the recording device 11 according to the embodiment, the correction transport control is performed. First, the measurement of the measurement distance LA is described.

Measurement of Measurement Distance

In the inspection process before the shipment of the recording device 11, the recording device 11 is set to the measurement mode. A worker gives thickness information identifying the thickness of the medium M to the recording device 11, or the thickness information is stored in the nonvolatile memory 104 of the recording device 11 in advance. When the controller 100 receives a measurement start operation, the controller 100 drives and controls the transport motor 71 in the measurement mode. For example, when test recording is performed on the medium M multiple times, the recording device 11 alternately repeatedly performs an operation of transporting the medium M by the feeding amount a for each pass and an operation of performing recording for each pass, thereby performing the test recording on the medium M, for example. When the test recording is not performed, the recording device 11 transports the medium M for only measurement. In this case, the recording device 11 may intermittently transport the medium M by the feeding amount for each pass or may transport the medium M to a target position at a fixed transport speed. In both cases, at the time of passage of the rear end Mb of the medium M through the nipping point N1, the controller 100 performs control to transport the medium M at the fixed speed. After that, the controller 100 performs control to stop the rear end Mb at a position within the kicking region KA. In this case, the actual nipping position NP is not yet measured and thus the nipping position NP based on the design of the recording device 11 and the kicking region KA based on the design are used. In the measurement mode, the controller 100 may cause the medium M to pass through the nipping point N1 at a fixed transport speed.

In the measurement mode, the medium M is guided by a guide member temporarily attached to prevent the medium M from skewing. Alternatively, a skewing detection process of detecting whether the medium M skews may be performed. When a skew angle of the medium M that exceeds a threshold is not detected, the measurement is treated to be valid. When the skew angle that exceeds the threshold is detected, the measurement is performed again.

In the measurement mode, when the medium detector 76 detects the rear end Mb, the controller 100 resets the first counter 111. After the resetting, the first counter 101 counts the number of pulse edges of the detection pulse signal ES from the encoder 74, for example. The first counter 101 counts the value indicating the position of the rear end Mb as the transport position y using, as the original point, the position of the medium M when the medium detector 76 detects the rear end Mb. The controller 100 monitors the current of the transport motor 71 in the measurement mode. When the medium detector 76 detects the rear end Mb and the controller 100 detects a temporal falling peak of the motor current, the controller 100 acquires, as the release position EP, the position of the lowest point Imin of the peak.

The controller 100 reads the information identifying the thickness of the medium M and the table data from the nonvolatile memory 104, references the table data based on the thickness information, and acquires the distance Lne associated with the thickness information. Then, the controller 100 calculates the nipping position NP (=ye−Lne) by subtracting the distance Lne from a value ye indicating the release position EP. The nipping position NP is indicated by a value yn indicating the position of the nipping position NP on the transport path using the detection position SP as the original point. Specifically, the value yn indicating the nipping position NP corresponds to the measurement distance LA from the detection position SP to the nipping position NP. The controller 100 causes the measurement distance LA to be stored in the predetermined storage region of the nonvolatile memory 104. After the controller 100 measures the measurement distance LA and causes the measurement distance LA to be stored, the controller 100 terminates the measurement mode. The recording device 11 is shipped after the necessary inspection before the shipment is terminated.

Correction Transport Control

Next, the case where the user who has purchased the recording device 11 uses the recording device 11 to perform recording on the medium M is described. The recording device 11 is, for example, coupled to and able to communicate with a host device (not illustrated) via a cable or wirelessly. The user operates an input operating section to select an image to be recorded or the like and set a recording condition while viewing a screen of a monitor of the host device. After that, the user instructs the recording device 11 to perform recording. The input operating section is a pointing device, such as a keyboard or a mouse, or the like.

The recording condition includes the thickness information identifying the thickness of the medium M. The thickness information is, for example, medium type information identifying the thickness of the medium M. The medium type information includes information of normal paper or dedicated paper, such as photo paper. When the medium type information indicates normal paper, the thickness information identifies that the thickness of the medium M is small. When the medium type information indicates dedicated paper, the thickness information identifies that the thickness of the medium M is large. The small thickness is set to a predetermined value in a range of 0.08 mm to 0.16 mm. The large thickness is set to a predetermined value in a range of 0.2 mm to 0.27 mm. The recording information includes recording modes and recording colors. The recording modes include the standard recording mode and the high-definition recording mode. The recording colors include colors and a grayscale. A recording resolution in the high-definition recording mode is higher than a recording resolution in the standard recording mode. As the recording resolution becomes higher, the minimum feeding amount a of the medium M becomes smaller. When the host device receives a recording instruction, the host device outputs the recording data RD to the recording device 11.

When the controller 100 receives the recording data RD, the controller 100 drives the recording device 11 based on the recording data RD. First, the controller 100 transports the medium M by driving the feeding motor 35 and the transport motor 71. When the medium M reaches a recording start position, the controller 100 moves the carriage 24 in the scan direction X and performs a recording operation of ejecting liquid drops from the nozzles 25N of the recording head 25 in the process of moving the carriage 24. After that, the controller 100 performs recording on the medium M by alternately performing an operation of transporting the medium M to a next recording position and a recording operation. In the recording, the medium M is subjected to the first transport process, the second transport process, and the third transport process.

As illustrated in FIG. 10, in the recording, the controller 100 receives the medium detection signal MS from the medium detector 76 and receives the detection pulse signal ES from the encoder 74. In the middle of the second transport process, the medium detector 76 detects the rear end Mb of the medium M. When the medium detector 76 detects the rear end Mb and the medium detection signal MS is switched from the detection state to the non-detection state, the controller 100 resets the first counter 101. After that, the first counter 101 counts the value indicating the transport position y of the rear end Mb.

As illustrated in FIG. 10, when the medium M is stopped for the first time after the medium detector 76 detects the rear end Mb, the controller 100 reads the measurement distance LA from the nonvolatile memory 104. The calculator 103 of the controller 100 calculates the remaining distance c (=LA−b) by subtracting, from the measurement distance LA, the remaining feeding amount b that is the distance from the detection position SP to the rear end Mb. Next, the calculator 103 calculates c/a. The quotient of c/a indicates n−1 (n is a natural number of 2 or greater) that is the number of transport operations to be performed before the rear end Mb reaches the nipping position NP. The remainder of c/a indicates the remaining distance d from the rear end Mb of the medium M after the number n−1 of transport operations are completed to the nipping position NP. The calculator 103 subtracts the remaining distance d from the feeding amount a for the next (n-th) transport operation, thereby calculating the distance D (=a−d) from the nipping position NP to the rear end Mb of the medium M transported in the n-th transport operation.

The controller 100 judges whether the distance D exceeds the set length D0 of the kicking region KA (whether D>D0 is established). When D>D0, the n-th transport operation causes the rear end Mb to cross the kicking region KA and thus the controller 100 does not adjust the feeding amount for a transport operation.

On the other hand, when D≤D0, the n-th transport operation causes the rear end Mb to be stopped at a position within the kicking region KA. The controller 100 adjusts and reduces the feeding amount a for at least one of the number n of transport operations in such a manner that the n+1-th transport operation causes the rear end Mb to cross the kicking region KA. In the embodiment, an adjustment amount a1 to be subtracted by the controller 100 from the feeding amount a for at least one of the number n of transport operations is a value larger than the distance D and smaller than the feeding amount a for one transport operation. In other words, the adjustment amount a1 is a value satisfying a condition of D<a1<a. By using the adjustment amount a1 to adjust and reduce the feeding amount a for at least one of the number n of transport operations, the rear end Mb of the medium M completely transported in the n-th transport operation is stopped before reaching the nipping position NP.

As illustrated in FIG. 11, the controller 100 uses the adjustment amount a1 to correct the feeding amount a for at least one of the number n (n is a natural number of 2 or greater) of transport operations. In the example illustrated in FIG. 11, the controller 100 corrects the feeding amount a for one of the number n of transport operations to the corrected feeding amount of a−a1 that is shorter by the adjustment amount a1 than the feeding amount a. In the embodiment, the controller 100 corrects the feeding amount a for one of the first to p-th (p is the largest natural number not larger than n/2) transport operations among the number n of transport operations to the corrected feeding amount of a−a1. In the example illustrated in FIG. 11, the controller 100 corrects the feeding amount a for the first transport operation among the number n of transport operations to the corrected feeding amount of a−a1. In this manner, the controller 100 judges the feeding amount to be adjusted, based on the remainder d of c/a that indicates the remaining distance after the number n of transport operations are performed. The number n is indicated by the quotient of c/a. Specifically, the feeding amount a and the distance D calculated based on D=a−d are used to calculate the adjustment amount a1 satisfying D<a1<a based on a1=D+α.

After the controller 100 corrects the feeding amount by the simulation calculation in the foregoing manner, the controller 100 performs the number n+1 of transport operation using the feeding amounts of a−a1, a, . . . , and a illustrated in FIG. 11. As illustrated in FIG. 11, by performing at least one of the number n+1 of transport operations to transport the medium M by the corrected feeding amount of a−a1, the n+1-th transport operation causes the rear end Mb to cross the kicking region KA.

Specifically, by performing the correction transport illustrated at the bottom in FIG. 8, the n+1-th transport operation causes the rear end Mb of the medium M to cross the kicking region KA. In the example in which the medium M is transported without correction as illustrated at the second top in FIG. 8, the transport position ys2 at which the rear end Mb of the medium M is stopped by kicking KF deviates by the deviation Δy from the target position ys1 at which the rear end Mb is to be originally stopped. On the other hand, in the correction transport illustrated at the bottom in FIG. 8, the rear end Mb of the medium M is stopped at a target position yrs at which the rear end Mb is to be originally stopped or at a position very close to the target position yrs immediately after the n+1-th transport operation.

In FIGS. 8 and 11, when the rear end Mb of the medium M crosses the kicking region KA, the transport speed of the medium M is a fixed speed or a speed close to the fixed speed and is higher than the speed of the medium M in the stopping process. Therefore, even when the medium M being transported receives kicking force from the transport roller set 41, an effect of changing the speed of the medium due to kicking force is small. In addition, the discharge roller set 42 rotates at a relatively high speed. Therefore, even when the medium M receives kicking force, slipping is less likely to occur between the medium M and the discharge roller set 42. As a result, the medium M is stopped at the target position yrs and a position very close to the target position yrs.

As illustrated in FIGS. 12 and 13, in a next recording operation after the transport of the medium M by the corrected feeding amount, it is necessary to correct an image to be formed by ejecting liquid drops LQ from the nozzles 25N of the recording head 25. As illustrated in FIG. 12, when the medium M is transported by the feeding amount a in each transport operation, recording layers PA with the same length as the feeding amount a in the transport direction Y0 are sequentially continuously formed. After the recording illustrated in FIG. 12 is completed, the medium M is transported by the corrected feeding amount of a−a1.

As illustrated in FIG. 13, as a result of the correction transport, a portion of a previous recording layer PA is present at a position opposite to some nozzles 25N of the reading head 25. Therefore, the recording head 25 uses nozzles 25N that are among all the nozzles 25N and present upstream in the transport direction Y0 to eject liquid drops LQ onto a region with the same length as the corrected feeding amount of a−a1 in the transport direction Y0. In this case, the controller 100 allocates an image continuous to an image of the recording layer PA formed in the previous recording operation to the nozzles 25 to be used to eject the liquid drops LQ. In other words, the controller 100 shifts an image having a length a and to be recorded in the next recording operation upstream in the transport direction Y0 by the adjustment amount a1, allocates the shifted image to the nozzles 25 present upstream, and uses the nozzles 25 present upstream to form a recording layer PA1 with the length of a−a1.

Figure 14:
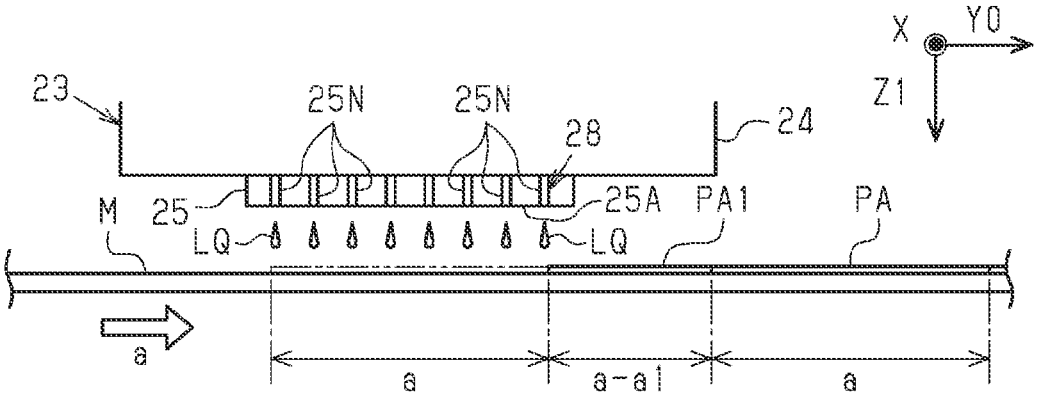
FIG. 14 is a schematic side view describing a recording operation performed on the medium transported by a normal feeding amount after the correction transport.

After the correction transport and the correction recording, the medium M is transported again by the feeding amount a in each transport operation, as illustrated in FIG. 14. Therefore, a current recording layer PA is formed and continuous to the previous recording layer PA1. When the medium M is transported by the corrected feeding amount of a−a1, nozzles 25N to be used and an image to be allocated to the nozzles 25 to be used are adjusted based on the adjustment amount a1. Therefore, the recording layer PA1 can be formed in such a manner that an image of the recording layer PA1 is continuous to images of recording layers PA formed immediately before and after the formation of the recording layer PA1.

According to the foregoing embodiment, the following effects are obtained.

(1) The recording device 11 includes the recording head 25 that performs recording on the recording medium M, and the transport roller set 41 including the transport driving roller 410 and the transport driving rollers 43 that transport the recording medium M toward the recording head 24 in the transport direction Y0. The recording device 11 further includes the medium detector 76 that detects an end of the recording medium M at a position upstream of the transport roller set 41 in the transport direction Y0, the encoder 74 that detects a rotational amount of the transport driving roller 410, and the controller 100 that controls the driving source that drives the transport driving roller 410. The controller 100 judges whether the rear end Mb that is an upstream end of the medium in the transport direction Y0 crosses the kicking region KA set in a range present downstream of the nipping position NP of the transport roller set 41 in the transport direction Y0 and shorter than the amount of feeding of the recording medium M by the transport roller set 41. When the controller 100 judges that the rear end Mb does not cross the kicking region KA, the controller 100 adjusts the feeding amount for at least one of a plurality of transport operations to be performed until the rear end Mb of the recording medium M reaches the kicking region KA in such a manner that the rear end Mb of the recording medium M crosses the kicking region KA. According to this configuration, since the amount of the feeding of the recording medium in the transport operation is adjusted, the medium M is stopped after the rear end Mb of the medium M crosses the kicking region KA. Even when the rear end Mb of the medium is kicked at the time of release of the rear end Mb from the nipping by the transport roller set 41, it is possible to suppress a reduction in the accuracy of the transport position that is caused by a deviation of a stop position of the medium M from a target position. This suppresses a reduction in the accuracy of a recording position at which the recording head 25 performs recording on the medium. In addition, since it is not necessary to reduce the transport speed of the medium M in order to reduce the kicking when the rear end Mb of the medium M passes through the nipping point N1, it is possible to improve recording throughput.

(2) After the rear end Mb of the medium M is detected by the medium detector 76, the controller 100 judges whether the rear end Mb crosses the kicking region KA. According to this configuration, the position of the rear end Mb of the medium M that is detected by the medium detector 76 is used as a standard to determine whether the rear end Mb of the medium M crosses the kicking region KA, and thus the determination is made with high accuracy, compared to a configuration in which the position of the front end of the medium M when the front end of the medium M is detected is used as a standard to determine whether the rear end Mb of the medium M crosses the kicking region KA. Therefore, it is possible to reliably suppress a reduction in a recording quality that is caused by the kicking of the medium M by the transport roller set 41.

(3) The driving source is the transport motor 71 that drives the transport driving roller 410. The controller 100 detects a change in the current of the transport motor 71 or a change in the voltage of the transport motor 71 at the time of passage of the rear end Mb of the recording medium M through the transport roller set 41 and sets the nipping position NP based on a result of detecting the change. According to this configuration, even when an attachment position of the transport roller set 41 varies, the actual nipping position NP of the transport roller set 41 can be set. Therefore, the kicking region KA suitable for the individual difference of the recording device 11 can be set. It is possible to suppress a reduction in a recording quality that is caused by the kicking of the medium M at the time of release of the rear end Mb of the medium from the nipping by the transport roller set 41.

(4) The controller 100 measures, based on the detection pulse signal ES output by the encoder 74, the distance from the detection position SP where the medium detector 76 has detected the rear end Mb of the medium to the position where the controller 100 has detected a change in the current of the transport motor 71 or a change in the voltage of the transport motor 71, and causes the measured distance to be stored as the measurement distance LA in the nonvolatile memory 104. The controller 100 adjusts the feeding amount based on the measurement distance LA and the remaining feeding amount of the transport operation that causes the rear end Mb to pass through the detection position SP where the medium detector 76 has detected the rear end Mb. The remaining feeding amount is the distance from the detection position SP to the rear end Mb. According to this configuration, even when a distance between the detection position SP of the medium detector 76 and the nipping position NP of the transport roller set 41 varies due to a variation in attachment positions of the medium detector 76 and the transport roller set 41, the feeding amount can be adjusted based on the appropriate nipping position NP. Therefore, it is possible to suppress a reduction in the accuracy of the stop position of the medium that is caused by the kicking.

(5) The recording device 11 includes the nonvolatile memory 104 that stores the measurement distance measured from the detection position SP of the medium detector 76 to the nipping position NP of the transport roller set 41 in the manufacturing of the recording device 11. According to this configuration, the measurement distance LA is stored in the nonvolatile memory 104 in advance and it is possible to reduce a reduction, caused by the kicking, in the recording quality from a recording quality in recording performed for the first time after the purchase of the recording device 11 by the user.

(6) The controller 100 treat, as the distance LA, the distance between the detection position SP of the medium detector 76 and the nipping position NP of the transport roller set 41, treats the feeding amount for one transport operation as the amount a, and treats, as the amount b, the remaining feeding amount of the transport operation that causes the rear end Mb to pass through the detection position SP. The remaining feeding amount is the distance from the detection position SP to the rear end Mb. The remaining distance c from the rear end Mb of the medium M transported by the remaining feeding amount b to the nipping position NP is a value of LA−b. The controller 100 judges the feeding amount to be adjusted, based on the remainder of c/a that indicates the remaining distance after the number n of transport operations indicated by the quotient of c/a are performed. According to this configuration, the feeding amount can be appropriately adjusted. Therefore, even when the rear end Mb of the medium is kicked at the time of release of the rear end Mb from the nipping by the transport roller set 41, it is possible to suppress a reduction in the recording quality that is caused by the stop of the medium at a position deviating from a target position.

(7) The controller 100 adjusts the feeding amount to an amount shorter than the feeding amount. According to this configuration, it is possible to continuously perform previous recording and current recording before and after an operation of transporting the recording medium M by the adjusted feeding amount in such a manner that a gap is not present between images formed in the previous recording and the current recording, regardless of the recording mode or the type of the recording device.

(8) The recording medium M to be subjected to the correction transport control is dedicated paper. According to this configuration, it is possible to perform recording on the dedicated paper with a high recording quality.

(9) When the number of transport operations from a transport operation to be performed immediately after a transport operation that causes the rear end Mb to pass through the detection position SP of the medium detector 76 to a transport operation that causes the rear end Mb of the medium to be stopped in the kicking region KA is n (n is a natural number of 2 or greater) and the largest natural number not larger than n/2 is p, the controller 100 adjusts the feeding amount for at least one of the first to p-th transport operations among the number n of transport operations. According to this configuration, it is possible to separate, in the transport direction Y0, a position where the recording quality is not uniform due to the kicking from a position where the recording quality is not uniform due to the adjustment of the feeding amount. Therefore, a reduction in the recording quality is hardly noticeable.

(10) The controller 100 changes the set length of the kicking region KA in the transport direction Y0 based on the thickness of the recording medium M to be subjected to recording by the recording head 25. According to this configuration, it is possible to set the length of the kicking region KA to an appropriate length based on the thickness of the recording medium M to be subjected to recording. Therefore, it is possible to suppress a reduction in the recording quality that is caused by the kicking of the medium.

(11) The controller 100 has a first recording mode in which recording is performed at a first recording resolution and a second recording mode in which recording is performed at a second recording resolution higher than the first recording resolution. Lengths of the kicking region in the transport direction are set for the first and second recording modes in such a manner that the set length of the kicking region KA in the transport direction Y0 in the first recording mode is different from the set length of the kicking region KA in the transport direction Y0 in the second recording mode. According to this configuration, it is possible to set the length of the kicking region KA to an appropriate length based on the recording mode. Therefore, it is possible to appropriately suppress, for each of the recording modes, a reduction in the recording quality that is caused by the kicking of the medium.

(12) The controller 100 adjusts, based on the adjustment amount for the feeding amount, a recording region for the recording medium M in the transport direction Y0 in a recording operation performed on the recording medium M by the recording head 25 immediately after a transport operation of transporting the medium M by the adjusted feeding amount. According to this configuration, the recording region in which the recording head 24 performs recording on the recording medium M based on the adjustment amount for the feeding amount is adjusted in the transport direction Y0. Therefore, it is possible to perform recording on a recording region continuous to a previous recording region even when the feeding amount of the recording medium M is adjusted.

(13) There is provided the method for controlling the recording device 100 including the recording head 25, the transport roller set 41, the medium detector 76 that detects an end of the recording medium M at a position upstream of the transport roller set 41 in the transport direction Y0, the encoder 74 that detects a rotational amount of the transport driving roller 410, and the controller 100 that controls the driving source that drives the transport driving roller 41. This control method includes the following (a) and (b). In (a), the controller 100 judges whether the rear end Mb that is an upstream end of the medium in the transport direction Y0 crosses the kicking region KA set in a range present downstream of the nipping position NP of the transport roller set 41 in the transport direction Y0 and shorter than the amount of feeding of the recording medium M by the transport roller set 41. In (b), when the controller 100 judges that the rear end Mb does not cross the kicking region KA, the controller 100 adjusts the feeding amount for at least one of a plurality of transport operations to be performed until the rear end Mb of the recording medium M reaches the kicking regions KA in such a manner that the rear end Mb of the recording medium M crosses the kicking region KA. According to the control method, it is possible to suppress a reduction in the recording quality that is caused by the kicking of the recording medium M by the transport roller set 41.

The foregoing embodiment may be changed to the following modifications. Combinations of the foregoing embodiment and the following modifications may be treated as modifications of the embodiment. Combinations of the following modifications may be treated as modifications of the embodiment.

Figure 15:
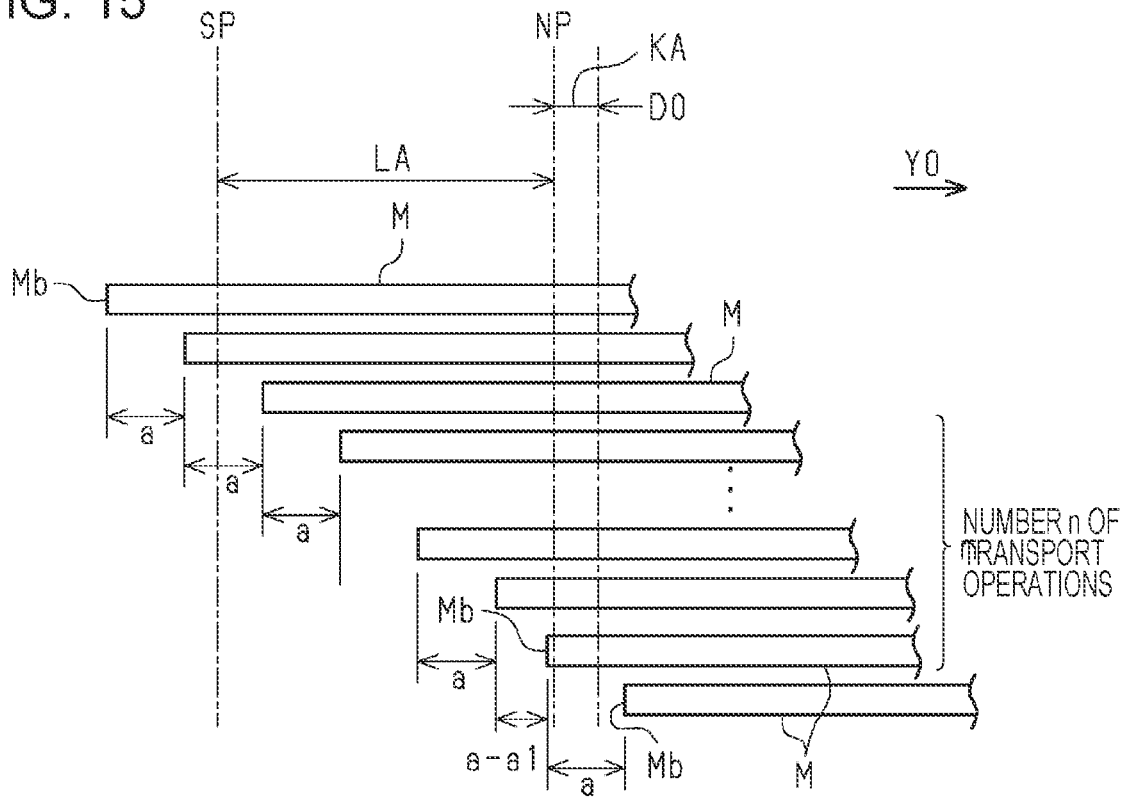
FIG. 15 is a schematic diagram illustrating a modification in which the medium is transported by the corrected feeding amount when the rear end of the medium is positioned near the nipping position.

As illustrated in FIG. 15, the feeding amount a may be corrected for a transport operation that is among the number n (n is a natural number of 2 or greater) of transport operations and is performed when the rear end Mb is positioned closer to the nipping position NP than to the detection position SP. Specifically, when the number of transport operations from a transport operation to be performed immediately after a transport operation that causes the rear end Mb to pass through the detection position SP of the medium detector 76 to a transport operation that causes the rear end Mb of the medium to be stopped in the kicking region KA is n and the smallest natural number not smaller than n/2 is q, the controller 100 adjusts the feeding amount for at least one of the q-th and subsequent transport operations among the number n of transport operations. According to this configuration, even when the transport position of the medium M deviates from a target position due to the adjustment of the feeding amount, a position where the recording quality is not uniform due to the deviation is on a circumferential edge portion of the medium M and is hardly noticeable when the user views the recorded matter, compared to the configuration described in the embodiment. Specifically, a position where the recording quality is not uniform due to the adjustment of the feeding amount can be on the circumferential edge portion of the medium. Therefore, a reduction in the recording quality is hardly noticeable.

Figure 16:
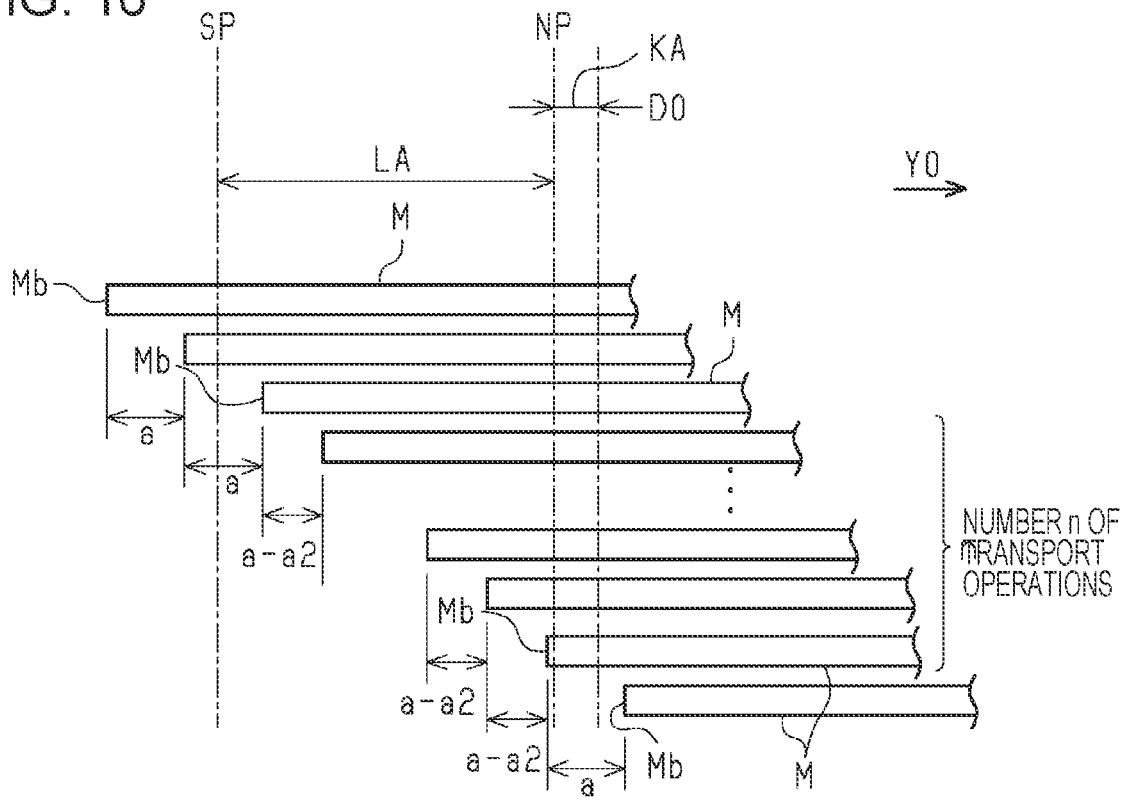
FIG. 16 is a schematic diagram illustrating a modification in which corrected feeding amounts are distributed to a plurality of transport operations.

As illustrated in FIG. 16, the adjustment of the feeding amounts a may be distributed to and performed in a plurality of transport operations among the number n of transport operations. The controller 100 distributes an adjustment amount for the feeding amounts that is necessary to cause the rear end Mb of the medium M to cross the kicking region KA to a plurality of transport operations among the number n (n is a natural number of 2 or greater) of transport operations from a transport operation to be performed immediately after a transport operation that causes the rear end Mb of the medium M to pass through the detection position SP of the medium detector 76 to a transport operation that causes the rear end M to be stopped in the kicking region KA. In the example illustrated in FIG. 16, the feeding amounts for the number n of transport operations are adjusted to a–a2. In this case, when the number of transport operations that are among the number n of transport operations and for which the feeding amounts a are corrected is r (r is a natural number of 2 or greater), the adjustment amount a2 is a value that is smaller than the adjustment amount a1 used in the modification illustrated in FIG. 15 (a2<a1) and satisfies an equation of a1=r·a2. According to this configuration, since a deviation of the transport position of the medium M due to the correction of the feeding amounts a is distributed, the non-uniformity of recording positions that is caused by the deviation of the transport position of the medium M is distributed. Specifically, the non-uniformity of the recording quality that is caused by the adjustment of the feeding amounts can be distributed to a plurality of portions. As a result, a reduction in the recording quality is hardly noticeable when the user views the recorded matter. When the distribution is performed, the feeding amount may be adjusted every other transport operation among the number n of transport operations.

The measurement of the nipping position NP and the measurement distance LA is not limited to the measurement performed when the recording device 11 is present in the manufacturing factory or is subjected to the inspection process before the shipment. For example, when the user operates the power control section 16 and turns on the recording device 11 for the first time after purchasing the recording device 11, the controller 100 displays, on a display section 15A, a guide screen for prompting the user to set a medium M and perform a predetermined operation. The user sets the medium M on the feeding tray 22 and operates the control panel 15 to perform the predetermined operation on the recording device 11. When the controller 100 receives an operation signal indicating that the predetermined operation has been performed by the user, the controller 100 transitions to the measurement mode. In the measurement mode, the controller 100 transports the medium M, monitors the medium detection signal MS of the medium detector 76 and the motor current of the transport motor 71, and measures the distance between the detection position SP and the nipping position NP based on the detection position SP and the position of the lowest value Imin of a peak of the motor current. The controller 100 causes the measured distance to be stored as the measurement distance LA in the predetermined storage region of the nonvolatile memory 104.

The controller 100 may transition to the measurement mode when the user performs recording on the medium M for the first time after purchasing the recording device 11. In the measurement mode, an operation of performing recording on the medium M and a process of measuring the nipping position NP and the distance LA in the middle of the recording operation may be performed. In this case, the recording to be performed on the medium M may be test recording of causing the recording device 11 to record a predetermined test pattern or a test sentence to test a recording state. The recording to be performed on the medium is not limited to the test recording and may be normal recording to record a sentence necessary for the user or an image necessary for the user.

The recording device 11 may have a configuration in which skewing of the medium M may be detected in the measurement mode. The controller 100 may use a skew angle of the medium M to correct the position of the lowest point Imin of a peak of the motor current and calculate the nipping position NP and the measurement distance based on the corrected position. A medium width sensor (not illustrated) included in the carriage 24 is used to detect the skew angle.

A sensor that detects the nipping position NP may be included in the recording device 11. The sensor is, for example, attached at a position where the sensor can detect the nipping position NP of the transport roller set 41. The sensor is attached with high position accuracy in such a manner that a distance between the sensor and the nipping point N1 of the transport roller set 41 in the transport direction Y0 is fixed. For example, the distance between the sensor and the nipping point N1 of the transport roller set 41 in the transport direction Y0 is accurately fixed by reducing the number of members interposed between a member that supports the transport roller set 41 and a member that supports the sensor. For example, the recording device 11 may have a configuration in which the member that supports the transport roller set 41 and the member that supports the sensor are a common member or a configuration in which the member that supports the sensor is directly fixed to the member that supports the transport roller set 41.

The sensor is, for example, a light reflection type optical sensor. In the measurement mode, when the rear end Mb of the medium M being transported reaches the nipping position NP, the sensor detects the rear end Mb of the medium M. The transport position y indicated by a value counted by the first counter 101 when the sensor detects the rear end Mb is measured as the nipping position NP. The measurement distance LA is measured as a value counted by the first counter 101 until the sensor for detecting the nipping position detects the rear end Mb after the first counter 101 is reset when the medium detector 76 detects the rear end Mb of the medium M. The measured measurement distance LA is stored in the nonvolatile memory 104. The sensor may be included in the recording device 11. However, the sensor may be temporarily attached using a tool in the inspection process before the shipment and may be removed from the recording device 11 when the measurement of the nipping position NP and the measurement distance LA is completed.

The correction transport control may be performed on a kicking region in which the rear end M of the medium M is kicked by the pressing members 81. The pressing members 81 are biased downward by the elastic member 82. The rear end Mb of the medium M is kicked at the time of separation of the rear end Mb of the medium M pressed downward by the pressing members 81 from the contact portions 815 of the pressing members 81. The correction transport control is performed to adjust the feeding amount for a transport operation to be performed before the rear end Mb reaches the nipping position NP in such a manner that the medium M is not stopped in a state in which the rear end Mb is at a position within the kicking region of the pressing members 81. In the correction transport control, the feeding amount is adjusted in such a manner that the rear end Mb crosses the kicking region KA (refer to as "first kicking region") of the transport roller set 41 and crosses the kicking region (refer to as "second kicking region") of the pressing members 81. When one or more transport operations are to be performed on the medium M between the first kicking region KA and the second kicking region, the feeding amount may be adjusted for one of the one or more transport operations, and the adjustment of the feeding amount for the first kicking region and the adjustment of the feeding amount for the second kicking region may be individually performed. The feeding amount may be adjusted to an amount shorter than the feeding amount, for example.

In the foregoing embodiment, the controller 100 judges whether the rear end Mb crosses the kicking region KA after the medium detector 76 detects the rear end Mb. However, after the medium detector 76 detects the front end that is a downstream end of the medium M in the transport direction Y0, the controller 100 may determine whether the rear end Mb crosses the kicking region KA. The length of the medium M in the transport direction Y0 is known. Therefore, when the front end of the medium M can be detected, the controller 100 can determine, based on recording data RD for one page, whether the rear end Mb crosses the kicking region KA. In this case, an amount of feeding of the medium to the recording start position may be adjusted, or the feeding amount for at least one of transport operations to be performed after an operation of performing recording on the medium M for a first pass is completed and until the rear end Mb reaches the kicking region KA may be adjusted.

When the medium M is transported in a transport operation that causes the rear end Mb to cross the kicking region KA, control may be performed to switch the transport speed to a lower speed than the normal speed. According to this configuration, even when the medium M receives kicking force from the transport roller set 41, it is possible to further reduce a deviation from a target position of the stopped medium M.

The correction transport control may not be performed in the first recording mode (for example, the standard recording mode) and may be performed in the second recording mode (for example, the high-definition recording mode).

The set length D0 of the kicking region KA may be the same, regardless of the recording mode.

The set length D0 of the kicking region KA may be the same, regardless of the thickness of the medium.

When the set length D0 of the kicking region KA needs to be significantly shorter than the distance Lne based on the condition for setting the length D0 to a length shorter than the minimum feeding amount a, the length D0 may be set to be in a range in which a peak of the kicking force is in a region separated downstream by a predetermined distance from the nipping position NP. The position of an upstream end of the kicking region KA may be different from the nipping position NP. The position of the upstream end of the kicking region may be located upstream of the nipping position NP or may be located downstream of the nipping position NP.

The pressing members 81 may not be provided.

The recording device 11 is not limited to the serial printer having the recorder 23 that reciprocates in the scan direction X. The recording device 11 may be a lateral printer having the recorder 23 that can move in two directions, a main scan direction and an auxiliary scan direction.

The recording device 11 may be a multifunction device having a reading unit.

The medium M is not limited to paper and may be a flexible plastic film, cloth, non-woven cloth, or the like or may be laminate.

The recording device 11 is not limited to a recording device that performs printing on a medium, such as paper. The recording device 11 may be a textile printing machine that performs printing on cloth.

The recording device 11 is not limited to the ink jet printer and may be a wire impact type recording device or a thermal transfer type recording device.

The recording device is not limited to a printer for printing. For example, the recording device may eject a liquid obtained by distributing or mixing particles of a functional material to or with a liquid and may be used to form an electric wire pattern on a substrate as an example of the medium or form pixels of various types of displays, such as a liquid crystal display, an electroluminescence (EL) display, and a surface-emitting display.

Technical ideas recognized from the embodiment and the modifications are described below together with effects of the technical ideas.

(A) A recording device includes a recording head that performs recording on a recording medium, a transport roller set including a transport driving roller and a transport driven roller that transport the recording medium toward the recording head in a transport direction, a medium detector that is disposed upstream of the transport roller set in the transport direction and detects an end of the recording medium, an encoder that detects a rotational amount of the transport driving roller, and a controller that controls a driving source that drives the transport driving roller. The controller judges whether a rear end that is an upstream end of the recording medium in the transport direction crosses a kicking region set in a range present downstream of a nipping position of the transport roller set in the transport direction and shorter than an amount of feeding of the recording medium by the transport roller. When the controller judges that the rear end does not cross the kicking region, the controller adjusts the feeding amount for at least one of a plurality of transport operations to be performed until the rear end of the recording medium reaches the kicking region in such a manner that the rear end of the recording medium crosses the kicking region.

According to this configuration, since the feeding amount for the operation of transporting the recording medium is adjusted, the medium is stopped after the rear end of the medium crosses the kicking region. Even when the rear end of the recording medium is kicked at the time of release of the rear end from the nipping by the transport roller set, it is possible to suppress a reduction in the accuracy of the transport position that is caused by the stop of the recording medium at a position deviating from a target position. This suppresses a reduction in the accuracy of a recording position where the recording head performs recording on the recording medium. Therefore, it is possible to suppress a reduction in the recording quality that is caused by the kicking of the recording medium by the transport roller set.

(B) In the foregoing recording device, after the rear end of the recording medium is detected by the medium detector, the controller may determine whether the rear end crosses the kicking region.

According to this configuration, since the controller uses, as a standard, the position of the rear end of the recording medium detected by the medium detector to determine whether the rear end of the recording medium crosses the kicking region, the determination is made with high accuracy, compared to the case where the controller uses, as a standard, the position of the front end of the recording medium when the front end of the recording medium is detected to determine whether the rear end of the recording medium crosses the kicking region. Therefore, it is possible to reliably suppress a reduction in the recording quality that is caused by the kicking of the recording medium by the transport roller set.

(C) In the foregoing recording device, the driving source may be a transport motor that drives the transport driving roller, and the controller may detect a change in a current of the transport motor or a change in a voltage of the transport motor at the time of passage of the rear end of the recording medium through the transport roller set and may set the nipping position based on a result of detecting the change.

According to this configuration, even when an attachment position of the transport roller set varies, the actual nipping position of the transport roller set can be set. Therefore, the kicking region suitable for an individual difference of the recording device can be set. It is possible to suppress a reduction in the recording quality that is caused by the kicking of the recording medium at the time of release of the rear end of the recording medium from the nipping by the transport roller set.

(D) In the foregoing recording device, the controller may measure, based on a detection pulse signal output by the encoder, a distance from a detection position where the medium detector detected the rear end of the recording medium to a position where the controller detected a change in the current of the transport motor or a change in the voltage of the transport motor, and the controller may cause the distance to be stored as a measurement distance in the nonvolatile memory and adjust the feeding amount based on the measurement distance and a remaining feeding amount of a transport operation that causes the rear end Mb to pass through the detection position SP where the medium detector detected the rear end. The remaining feeding amount is a distance from the detection position SP to the rear end.

According to this configuration, even when a distance between the detection position of the medium detector and the nipping position of the transport roller set varies due to a variation in an attachment position of the medium detector and the attachment position of the transport roller set, the feeding amount can be adjusted based on the appropriate nipping position. Therefore, it is possible to suppress a reduction, caused by the kicking, in the accuracy of a stop position of the recording medium.

(E) The foregoing recording device may include a nonvolatile memory that stores the measurement distance measured from the detection position of the medium detector to the nipping position of the transport roller set in manufacturing of the recording device.

According to this configuration, since the distance is stored in the nonvolatile memory in advance, it is possible to suppress a reduction in the recording quality that is caused by the kicking from the quality of recording performed for the first time after the purchase of the recording device by the user.

(F) In the recording device, when a distance between the detection position of the medium detector and the nipping position of the transport roller set is LA, the feeding amount for one transport operation is a, a remaining feeding amount of a transport operation in which the rear end of the recording medium is detected by the medium detector and that is a distance from the detection position where the medium detector has detected the rear end of the recording medium to the rear end of the recording medium is b, and a remaining distance from the rear end of the medium transported by the remaining feeding amount b to the nipping position is $c=LA-b$, the controller may determine the feeding amount to be adjusted, based on a remainder of c/a that indicates a remaining distance after a number n of transport operations indicated by a quotient of c/a are performed.

According to this configuration, it is possible to appropriately adjust the feeding amount. Therefore, even when the rear end of the recording medium is kicked at the time of release of the rear end from the nipping by the transport roller set, it is possible to suppress a reduction in the recording quality that is caused by the stop of the recording medium at a position deviating from a target position.

(G) In the recording device, the controller may adjust the feeding amount to an amount shorter than the feeding amount.

According to this configuration, it is possible to continuously perform previous recording and current recording before and after an operation of transporting the recording medium by the adjusted feeding amount in such a manner that a gap is not present between images formed in the previous recording and the current recording, regardless of the recording mode or the type of the recording device.

(H) In the recording device, the recording medium may be dedicated paper.

According to this configuration, it is possible to perform recording on the dedicated paper with a high recording quality.

(I) In the recording device, when the number of transport operations from a transport operation to be performed immediately after a transport operation that causes the rear end of the recording medium to pass through the detection position of the medium detector to a transport operation that causes the rear end of the recording medium to be stopped in the kicking region is n (n is a natural number of 2 or greater) and the largest natural number not larger than n/2 is p, the controller may adjust the feeding amount for at least one of the first to p-th transport operations among the number n of transport operations.

According to this configuration, a position where the recording quality is not uniform due to the kicking can be separated from a position where the recording quality is not uniform due to the adjustment of the feeding amount. Therefore, a reduction in the recording quality is hardly noticeable.

(J) In the recording device, when the number of transport operations from a transport operation to be performed immediately after a transport operation that causes the rear end of the recording medium to pass through the detection position of the medium detector to a transport operation that causes the rear end of the recording medium to be stopped in the kicking region is n (n is a natural number of 2 or greater) and the smallest natural number not smaller than n/2 is q, the controller may adjust the feeding amount for at least one of the q-th and subsequent transport operations among the number n of transport operations.

According to this configuration, a position where the recording quality is not uniform due to the adjustment of the feeding amount can be present on a circumferential edge portion of the recording medium. Therefore, a reduction in the recording quality is hardly noticeable.

(K) In the recording device, the controller may distribute an adjustment amount for feeding amounts that is necessary to cause the rear end of the recording medium to cross the kicking region to a plurality of transport operations among a number n (n is a natural number of 2 or greater) of transport operations from a transport operation to be performed immediately after a transport operation that causes the rear end of the recording medium to pass through the detection position of the medium detector to a transport operation that causes the rear end of the recording medium to be stopped in the kicking region.

According to this configuration, it is possible to distribute non-uniformity of the recording quality that is caused by the adjustment of the feeding amounts to a plurality of portions. Therefore, a reduction in the recording quality is hardly noticeable.

(L) In the recording device, the controller may change a set length of the kicking region in the transport direction based on a thickness of the recording medium to be subjected to recording by the recording head.

According to this configuration, it is possible to set the length of the kicking region to an appropriate length based on the thickness of the medium to be subjected to recording. Therefore, it is possible to suppress a reduction in the recording quality that is caused by the kicking of the recording medium.

(M) In the recording device, the controller may have a first recording mode in which recording is performed at a first recording resolution and a second recording mode in which recording is performed at a second recording resolution higher than the first recording resolution, and lengths of the kicking region in the transport direction may be set for the first and second recording modes in such a manner that the set length of the kicking region in the transport direction in the first recording mode is different from the set length of the kicking region in the transport direction in the second recording mode.

According to this configuration, the length of the kicking region may be set to an appropriate length based on the recording mode. Therefore, it is possible to appropriately suppress, for each of the recording modes, a reduction in the recording quality that is caused by the kicking of the recording medium.

(N) In the recording device, the controller may adjust, based on an adjustment amount for the feeding amount, a recording region for the recording medium in the transport direction in an operation of performing recording on the recording medium by the recording head immediately after an operation of transporting the recording medium by the adjusted feeding amount.

According to this configuration, the recording region in which the recording head performs recording on the recording medium is adjusted in the transport direction based on the adjustment amount for the feeding amount. Therefore, it is possible to perform recording on a recording region continuous to a previous recording region even when the feeding amount of the recording medium is adjusted.

(O) A method for controlling a recording device including a recording head that performs recording on a recording medium, a transport roller set including a transport driving roller and a transport driven roller that transport the recording medium toward the recording head in a transport direction, a medium detector that is disposed upstream of the transport roller set in the transport direction and detects an end of the recording medium, an encoder that detects a rotational amount of the transport driving roller, and a controller that controls the transport driving roller includes causing the controller to determine whether a rear end that is an upstream end of the recording medium in the transport direction crosses a kicking region set in a range present downstream of a nipping position of the transport roller set in the transport direction and shorter than an amount of feeding of the recording medium by the transport roller set and causing, when the controller judges that the rear end does not cross the kicking region, the controller to adjust the feeding amount for at least one of a plurality of transport operations to be performed until the rear end of the recording medium reaches the kicking region in such a manner that the rear end of the recording medium crosses the kicking region.

According to this method, it is possible to suppress a reduction in the recording quality that is caused by the kicking of the recording medium by the transport roller set.

What is claimed is:

1. A recording device comprising:

a recording head that performs recording on a recording medium;

a transport roller set including a transport driving roller and a transport driven roller that transport the recording medium toward the recording head in a transport direction; and a controller that controls a driving source that drives the transport driving roller, wherein the controller judges whether a rear end that is an upstream end of the recording medium in the transport direction crosses a kicking region set in a range present downstream of a nipping position of the transport roller set in the transport direction and shorter than an amount of feeding of the recording medium by the transport roller set, and when the controller judges that the rear end does not cross the kicking region, the controller adjusts the feeding amount for at least one of a plurality of transport operations to be performed until the rear end of the recording medium reaches the kicking region in such a manner that the rear end of the recording medium crosses the kicking region.

2. The recording device according to claim 1, further comprising:

a medium detector that detects an end of the recording medium at a position upstream of the transport roller set in the transport direction, wherein after the rear end of the recording medium is detected by the medium detector, the controller judges whether the rear end crosses the kicking region.

3. The recording device according to claim 1, wherein the driving source is a transport motor that drives the transport driving motor, and the controller detects a change in a current of the transport motor or a change in a voltage of the transport motor at a time of passage of the rear end of the medium through the transport roller set and sets the nipping position based on a result of detecting the change.

4. The recording device according to claim 3, further comprising:

an encoder that detects a rotational amount of the transport driving roller; and a nonvolatile memory, wherein the controller measures, based on a detection pulse signal output by the encoder, a distance from a detection position where a medium detector detected the rear end of the recording medium to a position where the controller detected a change in the current of the transport motor or a change in the voltage of the transport motor, and causes the distance to be stored as a measurement distance in the nonvolatile memory, and the controller adjusts the feeding amount based on the measurement distance and a remaining feeding amount of a transport operation that causes the rear end to pass through the detection position where the medium detector detected the rear end, the remaining feeding amount being a distance from the detection position to the rear end.

5. The recording device according to claim 4, wherein the nonvolatile memory stores the measurement distance measured in manufacturing of the recording device.

6. The recording device according to claim 1, wherein when a distance between a detection position of a medium detector and the nipping position of the transport roller set is LA, the feeding amount for one transport operation is a, a remaining feeding amount of a transport operation in which the rear end of the recording medium is detected by the medium detector and that is a distance from a detection position where the medium detector has detected the rear end of the recording medium to the rear end of the recording medium is b, and a remaining distance from the rear end of the recording medium transported by the remaining feeding amount b to the nipping position is c=LA−b, the controller judges the feeding amount to be adjusted, based on a remainder of c/a that indicates a remaining distance after a number n of transport operations indicated by a quotient of c/a are performed.

7. The recording device according to claim 1, wherein the controller adjusts the feeding amount to an amount shorter than the feeding amount.

8. The recording device according to claim 1, wherein the recording medium is dedicated paper.

9. The recording device according to claim 1, wherein when a number of transport operations from a transport operation to be performed immediately after a transport operation that causes the rear end of the recording medium to pass through a detection position of a medium detector to a transport operation that causes the rear end of the recording medium to be stopped in the kicking region is n that is a natural number of 2 or greater, and the largest natural number not larger than n/2 is p, the controller adjusts the feeding amount for at least one of first to p-th transport operations among the number n of transport operations.

10. The recording device according to claim 1, wherein when a number of transport operations from a transport operation to be performed immediately after a transport operation that causes the rear end of the recording medium to pass through a detection position of a medium detector to a transport operation that causes the rear end of the recording medium to be stopped in the kicking region is n that is a natural number of 2 or greater, and the smallest natural number not smaller than n/2 is q, the controller adjusts the feeding amount for at least one of q-th and subsequent transport operations among the number n of transport operations.

11. The recording device according to claim 1, wherein the controller distributes an adjustment amount for feeding amounts that is necessary to cause the rear end of the recording medium to cross the kicking region to a plurality of transport operations among a number n of transport operations from a transport operation to be performed immediately after a transport operation that causes the rear end of the recording medium to pass through a detection position of a medium detector to a transport operation that causes the rear end of the recording medium to be stopped in the kicking region, where n is a natural number of 2 or greater.

12. The recording device according to claim 1, wherein the controller changes a set length of the kicking region in the transport direction based on a thickness of the recording medium to be subjected to recording by the recording head.

13. The recording device according to claim 1, wherein the controller has a first recording mode in which recording is performed at a first recording resolution and a second recording mode in which recording is performed at a second recording resolution higher than the first recording resolution, and lengths of the kicking region in the transport direction are set for the first and second recording modes in such a manner that the set length of the kicking region in the transport direction in the first recording mode is different from the set length of the kicking region in the transport direction in the second recording mode.

14. The recording device according to claim 1, wherein the controller adjusts, based on an adjustment amount for the feeding amount, a recording region for the recording medium in the transport direction in a recording operation performed on the recording medium by the recording head immediately after an operation of transporting the recording medium by the adjusted feeding amount.

15. A method for controlling a recording device including a recording head that performs recording on a recording medium, a transport roller set including a transport driving roller and a transport driven roller that transport the recording medium toward the recording head in a transport direction, a medium detector that detects an end of the recording medium at a position upstream of the transport roller set in the transport direction, an encoder that detects a rotational amount of the transport driving roller, and a controller that controls a driving source that drives the transport driving roller, comprising:

causing the controller to determine whether a rear end that is an upstream end of the recording medium in the transport direction crosses a kicking region set in a range present downstream of a nipping position of the transport roller set in the transport direction and shorter than an amount of feeding of the recording medium by the transport roller set; and causing, when the controller judges that the rear end of the recording medium does not cross the kicking region, the controller to adjust the feeding amount for at least one of a plurality of transport operations to be performed until the rear end of the recording medium reaches the kicking region in such a manner that the rear end of the kicking region crosses the kicking region.

* * * * *